US009063469B2

(12) United States Patent
Ogura

(10) Patent No.: US 9,063,469 B2
(45) Date of Patent: Jun. 23, 2015

(54) IMAGE FORMING APPARATUS, IMAGE FORMING SYSTEM, AND RECORDING MEDIUM FOR PERFORMING IMAGE FORMING METHOD

(75) Inventor: Yoshimitsu Ogura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 1097 days.

(21) Appl. No.: 12/694,355

(22) Filed: Jan. 27, 2010

(65) Prior Publication Data

US 2010/0196025 A1 Aug. 5, 2010

(30) Foreign Application Priority Data

Feb. 4, 2009 (JP) ..... 2009-023998

(51) Int. Cl.
*G03G 15/11* (2006.01)
*G03G 21/00* (2006.01)
*G03G 21/02* (2006.01)

(52) U.S. Cl.
CPC ..... *G03G 15/11* (2013.01); *G03G 21/0088* (2013.01); *G03G 21/02* (2013.01)

(58) Field of Classification Search
USPC ..... 347/22, 23
See application file for complete search history.

(56) References Cited

U.S. PATENT DOCUMENTS

| | | | | |
|---|---|---|---|---|
| 7,758,180 | B2 * | 7/2010 | Kawabata | 347/104 |
| 2007/0120936 | A1 * | 5/2007 | Kawabata | 347/104 |
| 2008/0225070 | A1 | 9/2008 | Morishita et al. | |
| 2009/0028586 | A1 | 1/2009 | Yamashiro et al. | |
| 2009/0237744 | A1 | 9/2009 | Ogura et al. | |

FOREIGN PATENT DOCUMENTS

| | | |
|---|---|---|
| JP | 11-084916 | 3/1999 |
| JP | 2003-002477 | 1/2003 |
| JP | 2006-168150 | 6/2006 |
| JP | 2006-282315 | 10/2006 |
| JP | 2007-145523 | 6/2007 |

OTHER PUBLICATIONS

Japanese Office Action dated Feb. 26, 2013.

* cited by examiner

*Primary Examiner* — Uyen Chau N Le
*Assistant Examiner* — Kajli Prince
(74) *Attorney, Agent, or Firm* — IPUSA, PLLC

(57) ABSTRACT

An image forming apparatus including a receiving part for receiving an image forming request, a conveyor belt for rotating and conveying a recording paper, a charging part for applying charges to the conveyor belt, and an image forming part for forming an image on the recording paper is disclosed. The image forming apparatus includes a cleaning part configured to clean a surface of the conveyor belt by rotating the conveyor belt and setting a contacting member in contact with the surface of the conveyor belt when a bias voltage of the charges is reduced. The cleaning part is configured to clean the surface of conveyor belt when a printing process and a post-printing process are completed by the image forming part and no subsequent image forming request is received by the receiving part.

9 Claims, 20 Drawing Sheets

ENTRY
S200
ANY PRINTING JOB?
No
Yes
S201
PRINTING PROCESS
S211
COUNT PRINTING OF ONE PAGE
S212
HAVE PAGES ACCUMULATED FROM PREVIOUS BELT CLEANING PROCESS REACHED PREDETERMINED VALUE?
No
Yes
S205
BELT CLEANING PROCESS
S213
ALL PAGES OF RECEIVED JOB PRINTED?
No
Yes
S203
POST-PRINTING PROCESS
S204
ANY PRINTING JOB?
Yes
No
S205
BELT CLEANING PROCESS

IMAGE FORMING APPARATUS, IMAGE FORMING SYSTEM, AND RECORDING MEDIUM FOR PERFORMING IMAGE FORMING METHOD

BACKGROUND OF THE INVENTION

1. Field of the Invention

The present invention generally relates to an image forming apparatus, an image forming system, and a recording medium for performing an image forming method (e.g., inkjet method).

2. Description of the Related Art

In a known image forming apparatus that performs printing by conveying a sheet of paper on a charged conveyor belt, paper particles, for example, are wiped off from the conveyor belt by a cleaning blade contacting the conveyor belt and rotating the conveyor belt.

In Japanese Laid-Open Patent Publication No. 2007-145523 (hereinafter referred to as "Patent Document 1"), there is disclosed an image forming apparatus that performs printing by conveying a sheet of paper on a charged conveyor belt, in which paper particles, for example, are removed from the conveyor belt by a cleaning belt contacting the conveyor belt and driving the conveyor belt in a state where the bias voltage of the conveyor belt is reduced.

With the image forming apparatus disclosed in Patent Document 1, the time for performing a belt cleaning process is changed according to the number of printed papers. Because the belt cleaning process is performed whenever a printing process is completed, the image forming apparatus of Patent Document 1 may perform the belt cleaning process more than necessary. This results in noise being caused by unnecessary rotation of the conveyor belt and electric power being wasted.

SUMMARY OF THE INVENTION

The present invention may provide an image forming apparatus, an image forming system, and a recording medium for performing an image forming method that substantially eliminate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an image forming apparatus, an image forming system, and a recording medium for performing an image forming method particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an image forming apparatus including a receiving part for receiving an image forming request, a conveyor belt for rotating and conveying a recording paper thereon, a charging part for applying charges to the conveyor belt, and an image forming part for forming an image on the recording paper, the image forming apparatus including: a cleaning part configured to clean a surface of the conveyor belt by rotating the conveyor belt and setting a contacting member in contact with the surface of the conveyor belt when a bias voltage of the charges is reduced; wherein the cleaning part is configured to clean the surface of the conveyor belt when a printing process and a post-printing process are completed by the image forming part and another image forming request is not received by the receiving part.

Further, another embodiment of the present invention provides an image forming system including: a data processing apparatus configured to transmit an image forming request; and an image forming apparatus connected to the data processing apparatus, the image forming apparatus including a receiving part for receiving the image forming request from the data processing apparatus, a conveyor belt for rotating and conveying a recording paper thereon, a charging part for applying charges to the conveyor belt, an image forming part for forming an image on the recording paper, and a cleaning part configured to clean a surface of the conveyor belt by rotating the conveyor belt and setting a contacting member in contact with the surface of the conveyor belt when a bias voltage of the charges is reduced; wherein the cleaning part is configured to clean the surface of the conveyor belt when a printing process and a post-printing process are completed by the image forming part and another image forming request is not received by the receiving part.

Further, another embodiment of the present invention provides a recording medium on which a program is recorded for causing an image forming apparatus to perform an image forming method, the image forming method including the steps of: a) receiving an image forming request at the image forming apparatus; b) rotating a conveyor belt of the image forming apparatus; c) conveying a recording paper on the conveyor belt; d) applying charges to the conveyor belt, e) forming an image on the recording paper, f) performing a post-printing process, and g) cleaning a surface of the conveyor belt by rotating the conveyor belt and setting a contacting member in contact with the surface of the conveyor belt when a bias voltage of the charges is reduced, wherein the surface of conveyor belt is cleaned when steps e) and f) are completed and another image forming request is not received in step a).

Other objects, features and advantages of the present invention will become more apparent from the following detailed description when read in conjunction with the accompanying drawings.

DETAILED DESCRIPTION OF THE PREFERRED EMBODIMENTS

[First Embodiment]

Figure 1:
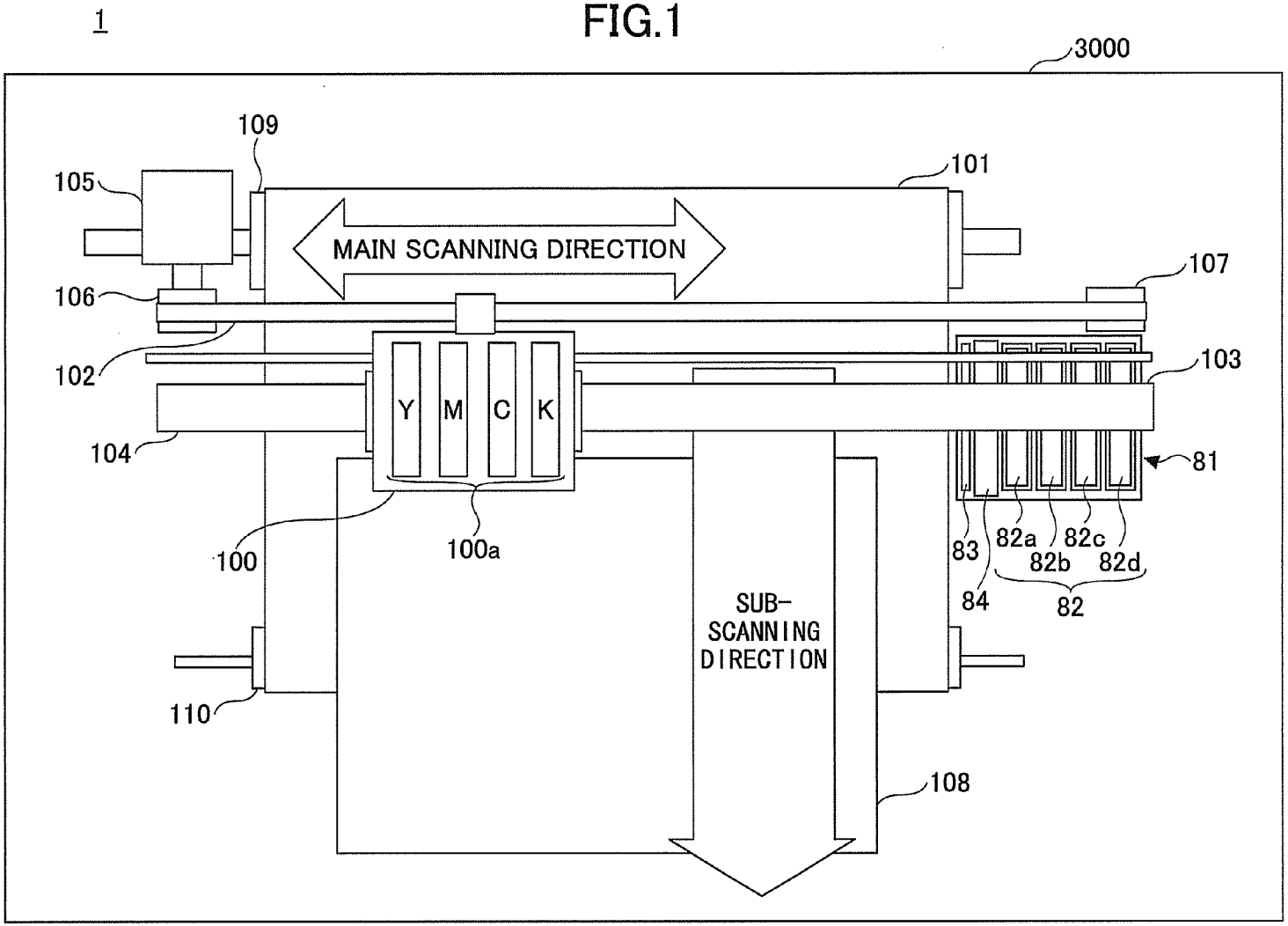
FIG. 1 is a top view of an image forming apparatus according to a first embodiment of the present invention.
Figure 2:
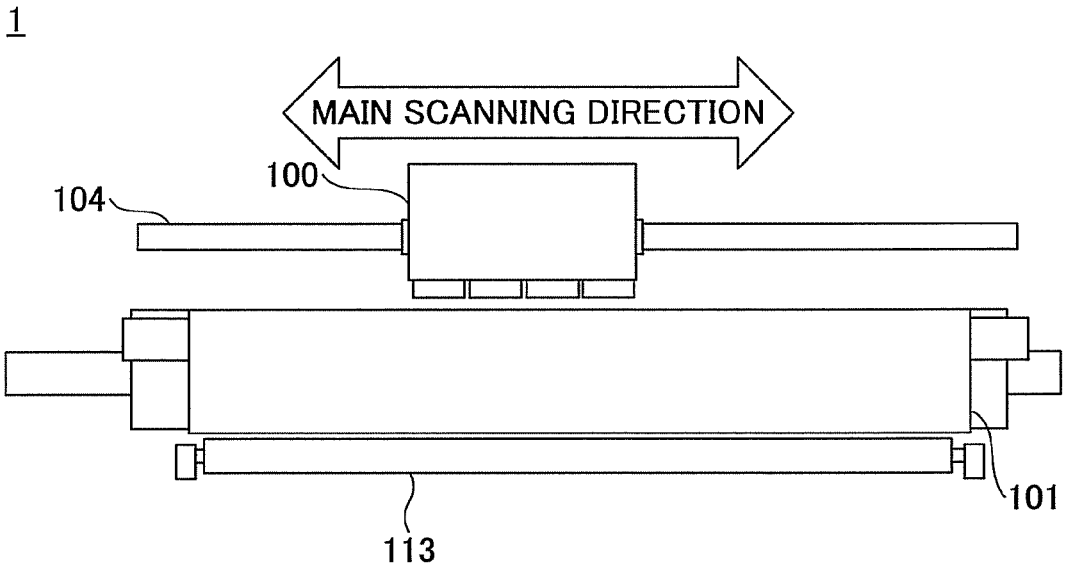
FIG. 2 is a front view of an image forming apparatus according to the first embodiment of the present invention.

FIG. 1 is a top view of an image forming apparatus (in this embodiment, an inkjet type image forming apparatus (also referred to as an inkjet recording apparatus)) 1 according to a first embodiment of the present invention. FIG. 2 is a front view of the image forming apparatus 1 according to the first embodiment of the present invention. The image forming apparatus according to the first embodiment is described with reference to FIGS. 1 and 2.

The image forming apparatus 1 includes a carriage 100 held by a guiding rod 104 horizontally spanning between left and right sideboards (not illustrated) of the image forming apparatus 1. By driving a main scanning motor 105, the carriage 100 is moved in a main scanning direction via a timing belt 102 spanning between a driving pulley 106 and a driven pulley 107. The image forming apparatus 1 also includes a cover that opens and closes for entirely or partly covering the inside of the image forming apparatus 1.

The carriage 100 has a recording head 100*a* including, for example, four liquid jetting heads for jetting ink droplets of yellow (Y), cyan (C), magenta (M), and black (K). The recording head 100*a* has plural inkjet nozzles arranged in a direction (sub-scanning direction) orthogonal to the main scanning direction. The recording head 100*a* is mounted on the carriage 100 so that the ink-jetting side of the recording head 100*a* is faced downward.

In an alternative embodiment, one or more recording heads having plural nozzle arrays corresponding to the colors of ink may be used. Further, the number of colors or the order of the nozzle arrays is not to be limited to those described in this embodiment.

The recording head 100*a* may include a pressure generating part for generating pressure for ejecting ink droplets. For example, the recording head 100*a* may include a piezoelectric device such as a piezoelectric actuator, a thermal actuator including an electro-thermal converting device (e.g., heating element) that utilizes pressure changes relative to boiling of a prescribed liquid, a shape-memory alloy actuator that utilizes changes of metal parts relative to changes of temperature, or an electrostatic actuator that utilizes electrostatic force.

The carriage 100 also includes an encoder scale 103 formed with slits arranged in the main scanning direction. The carriage 100 also includes an encoder sensor (not illustrated) for detecting the slits of the encoder scale 103. This combination of the encoder scale 103 and the encoder sensor serves as a linear encoder for detecting the position of the carriage 100 in the main scanning direction.

As illustrated in FIG. 1, a recovery mechanism 81 is provided in a non-recording region at one end (right side in this example) along the main scan direction of the carriage 100. The recovery mechanism 81 maintains the nozzles of the recording head 100*a* in a desired state by performing a recovery process to achieve the desired state if necessary. The recovery mechanism 81 includes a protective cap 82 formed by cap members 82*a* through 82*d* for capping the nozzle surfaces of each of the four heads forming the recording head 34, a wiper blade 83 for wiping the nozzle surfaces, and a receiving part 84 for receiving the ink jetted from the recording head 34 and not contributing to the recording when cleaning the recording head 34 to remove the unwanted ink with an increased viscosity sticking at the nozzles in a cleaning process performed during an idle state, a starting state or, a recording standby state of the image forming apparatus 1, for example. The cap member 82*a* may have functions to remove the unwanted ink jetted from the nozzles by suction and to maintain a desired wet state of the nozzles, while the other cap members 82*b* through 82*d* may have a function to maintain the desired wet state of the nozzles, for example.

In a recording standby state (or print standby state), for example, the carriage 100 is moved towards the recovery mechanism 81, and the recording head 100*a* is capped by the protective cap 82. Hence, the nozzles of the recording head 100*a* are maintained in a desired wet state, and an unstable ink-jet caused by hardening or drying of the ink is prevented. In the recovery process, a suction pump (not illustrated) sucks the ink from the nozzles capped by the protective cap 82, in order to remove the unwanted ink with the increased viscosity or air bubbles within the ink. The ink not contributing to the recording is jetted from the nozzles before the start of the recording or during the recording, so that the stable ink-jet performance of the recording head 100*a* can be maintained.

The image forming apparatus 1 includes a conveyor belt (conveying part) 101 for conveying a sheet(s) of recording paper 108 to a position facing the recording head 100*a* by using electrostatic attraction.

The conveyor belt 101 is an endless belt that spans between a conveyor roller 109 and a tension roller 110. The conveyor belt 101 rotates in a belt conveying direction (sub-scanning direction). The conveyor belt 101 is charged with electric charges by a charging roller 113 (see FIG. 2) while the conveyor belt 101 is being rotated.

Figure 3:
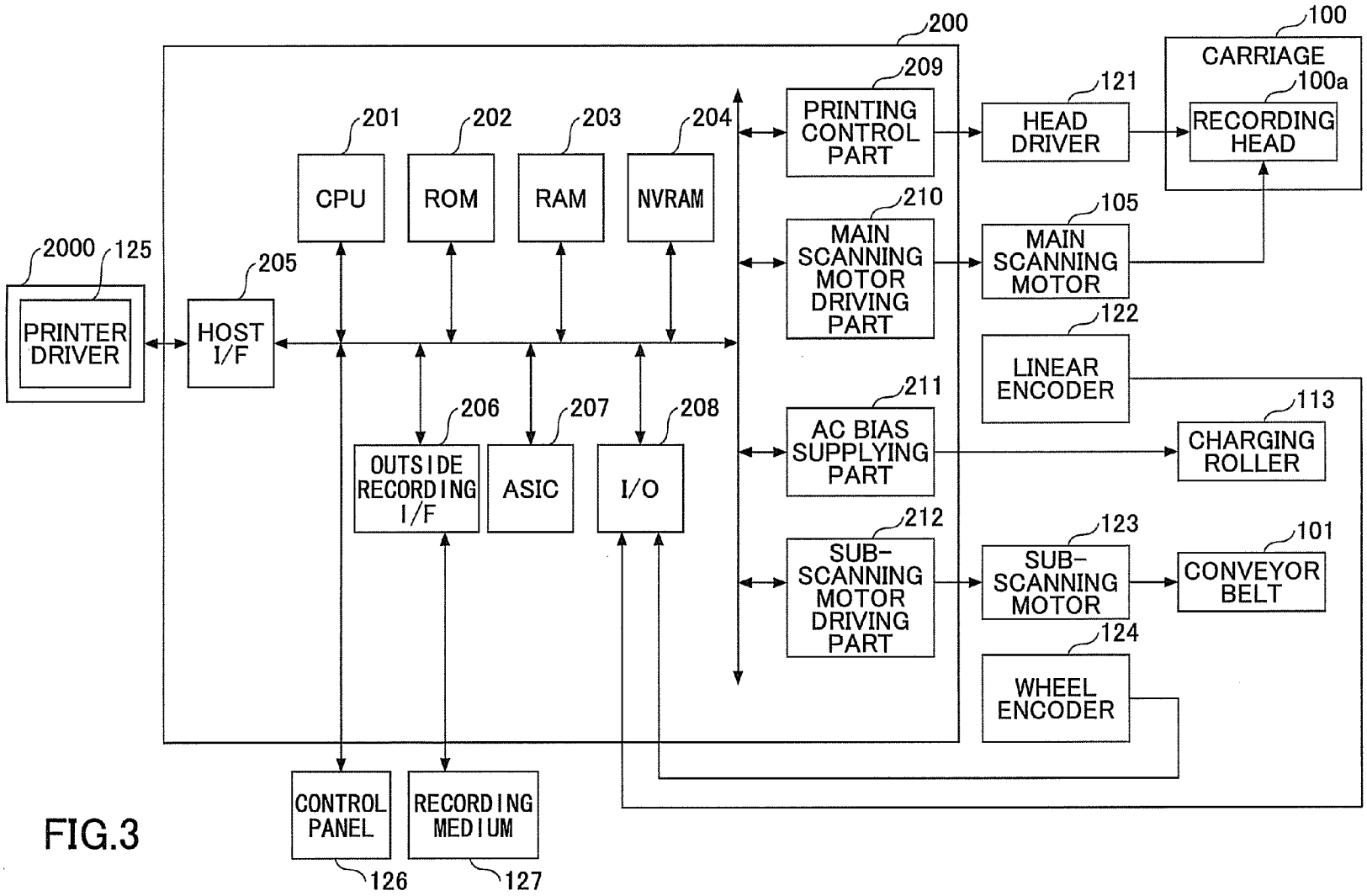
FIG. 3 is a block diagram for describing functions performed with a control part of an image forming apparatus according to an embodiment of the present invention.

The conveyor belt 101 may be a belt having a single layer structure or plural layer structure. In a case where the conveyor belt 101 has a single layer structure, the single layer of the conveyor belt 101 is formed entirely of an insulating material because the layer of the conveyor belt 101 contacts the recording paper 108 and the charging roller 113. FIG. 3 is a block diagram of the image forming apparatus 1 for describing functions performed with a control part 200 of the image forming apparatus 1. The control part 200 includes a CPU 201 for controlling the entire image forming apparatus 1 including, for example, the conveying of the recording paper 108 and the moving of the recording head 100*a*; a ROM 202 for storing programs and other data used by the CPU 200; a RAM 203 for temporarily storing, for example, image data; a rewritable non-volatile memory 204 for maintaining data even when the power of the image forming apparatus 1 is switched off; and an ASIC 207 for processing input/output signals used for performing signal processes on image data, performing image processes (e.g., re-arrangement), and assisting in controlling the entire image forming apparatus 1.

The control part 200 also includes a host I/F 205 for transmitting/receiving data or signals with respect to a host, an outside recording I/F 206 for transmitting/receiving data with respect to a recording medium 127, a printing control part 209 for generating a waveform for driving the recording head 100*a* and outputting various data (e.g., image data along with other additional data for selectively driving the pressure generating part of the recording head 100*a*) to a head driver 121, a main scanning motor driving part 210 for driving the main scanning motor 105, a sub-scanning motor driving part 212 for driving a sub-scanning motor 123, an AC bias supplying part 211 for supplying AC bias to the charging roller 113, and an I/O 208 for inputting detection pulses from a linear encoder 122 and a wheel encoder 124 and inputting other detection signals from other various sensors. Further, the control part 200 is connected to a control panel 126 used for inputting and displaying data used by the image forming apparatus 1.

In the control part 200, the host I/F 205 receives printing data, for example, generated by a printer driver 125 of a host 2000 via a cable or a network. The host 2000 may be, for example, a data processing apparatus (e.g., a personal computer), an image reading apparatus (e.g., an image scanner), or an image capturing apparatus (e.g., a digital camera).

In the control part 200, the CPU 201 reads out and analyzes printing data included in a reception buffer of the host I/F 205. Then, the ASIC 207 performs various processes on the printing data (e.g., image processing, rearranging of data). Then, the processed printing data are transferred to the printing control part 209. Then, the printing control part 209 outputs image data or a driving waveform to the head driver 121 at a predetermined timing.

It is to be noted that generation of dot pattern data for outputting images may be performed, for example, by storing font data in the ROM 202 or converting image data into bitmap data at the printer driver 125 of the host and transferring the converted data to the image forming apparatus 1. In this embodiment, the generation of dot pattern data is performed by the printer driver 125.

The printing control part 209 has a driving waveform generating part including, for example, amplifiers and D/A converters for performing D/A conversion on dot pattern data of driving pulses stored in the ROM 202 and read out by the CPU 201. The driving waveform generating part outputs a driving waveform(s) including one or more driving pulses to the head driver 121.

Based on serially input image data (dot pattern data) equivalent to a single row's worth of printing by the recording head 100*a*, the head driver 121 drives the recording head 100*a* by selectively applying the driving pulse(s) included in the driving waveform(s) obtained from the driving waveform generating part to the pressure generating part of the recording head 100*a*.

The head driver 121 includes, for example, a shift register for inputting clock signals and serial data (image data), a latch circuit for latching register values of the shift register with latch signals, a level changing circuit (level shifter) for changing the level of a value output from the latch circuit, and an analog switching array (switching part) that is switched on/off by the level shifter. By controlling the switching on/off of the analog switching array, predetermined driving pulses included in the driving waveforms are selectively applied to the pressure generating part of the recording head 100*a*.

The image forming apparatus 1 according to an embodiment of the present invention may be provided in an image forming system 1000 (see, for example, below-described FIGS. 5, 8, and 15). That is, the image forming system 1000 according to an embodiment of the present invention may have the image forming apparatus 1 and the data processing apparatus 2000 including the printer driver 125 directly connected to the image forming apparatus 1 or connected via a network.

Figure 4:
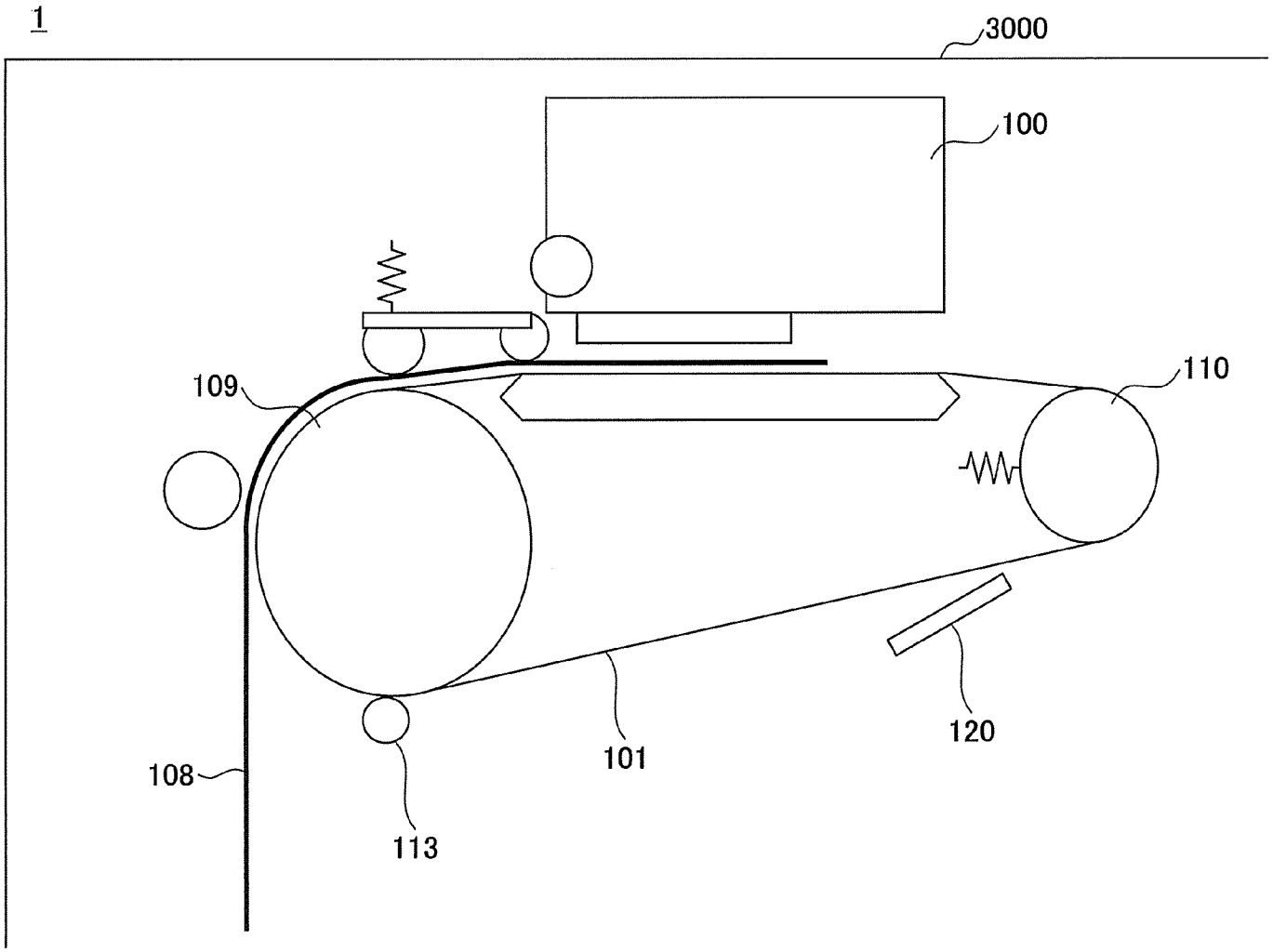
FIG. 4 is a side view of a paper conveying mechanism of an image forming apparatus according to an embodiment of the present invention.

FIG. 4 is a side view of a paper conveying mechanism of the image forming apparatus 1 according to an embodiment of the present invention. As illustrated in FIG. 4, the recording paper 108 is conveyed by the conveyor belt 101 in a state where the recording paper 108 electrostatically attracted to the conveyor belt 101 charged by the charging roller 113. In this state, foreign matter (e.g., paper particles) adhered to the recording paper 108 is caused to remain on the conveyor belt 101 by the electrostatic attraction of the conveyor belt 101. The electrostatic attracting force of the conveyor belt 101 may decrease due to the foreign matter remaining on the conveyor belt 101.

In order to remove the foreign matter such as paper particles, a cleaning blade 120 is set to contact the conveyor belt 101. Thereby, the cleaning blade 120 can wipe off the foreign matter as the conveyor belt 101 is rotated.

However, because the foreign matter is electrostatically attracted to the conveyor belt 101, all of the foreign matter might not be removed from the conveyor belt 101, and some of the foreign matter may remain on the conveyor belt 101. Therefore, in a case where multiple printing processes are consecutively performed, a large amount of foreign matter may remain on the conveyor belt 101. This results in the decrease of the electrostatic attracting force of the conveyor belt 101.

Accordingly, in order to prevent the decrease of electrostatic attracting force, there is a method of rotating the conveyor belt 101 for a predetermined distance where a bias voltage applied to the conveyor belt 101 is reduced. Thereby, the foreign matter on the conveyor belt 101 can be positively removed. This process is hereinafter referred to as a belt cleaning process.

The reduced bias voltage applied to the conveyor belt 101 may be, for example, no bias voltage (switched off of bias voltage). Because the electrostatic attracting force of the conveyor belt 101 is positively eliminated, foreign matter can be removed by the cleaning blade 120 more effectively.

In this embodiment, the bias voltage is AC bias voltage. Because movement (traveling) of charges can be avoided the more the frequency of AC bias is increased, the electrostatic attracting force of the conveyor belt 101 can be reduced by increasing the frequency of the AC bias voltage. Therefore, even in a case where the image forming apparatus 1 is not equipped with the function of switching off the bias voltage, the bias voltage can be reduced by increasing the frequency of the AC bias voltage. Accordingly, the electrostatic attracting force of the conveyor belt 101 can be reduced.

<Function Configuration>

Figure 5:
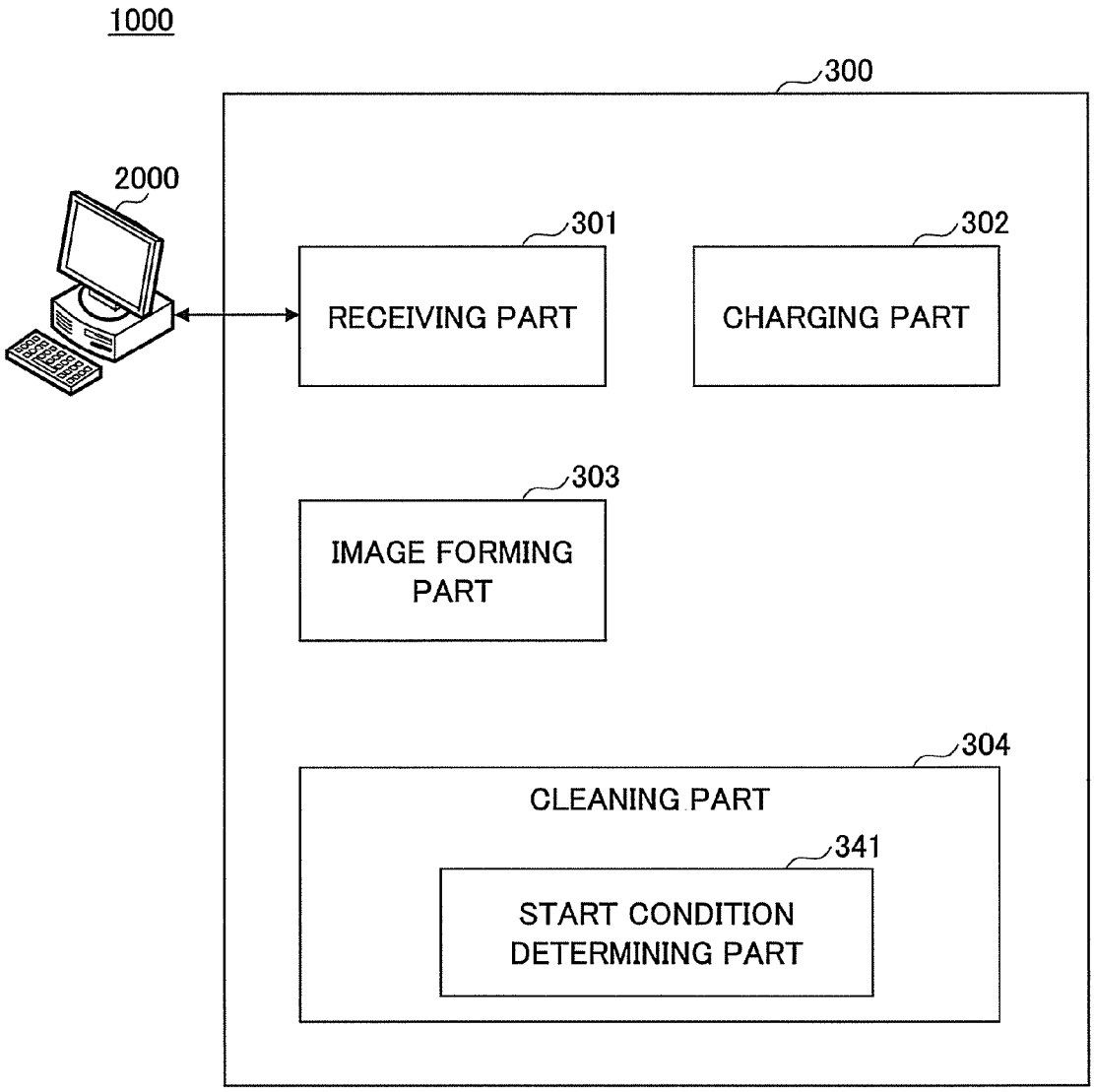
FIG. 5 is a block diagram illustrating a configuration for describing functions of an image forming apparatus according to the first embodiment of the present invention.

FIG. 5 is a block diagram illustrating a configuration for describing functions of an image forming apparatus 300 according to the first embodiment of the present invention. As illustrated in FIG. 5, the image forming apparatus 300 includes a receiving part 301, a charging part 302, an image forming part 303, and a cleaning part 304. Although the image forming apparatus 300 also includes one or more parts (e.g., control part 200) of the image forming apparatus 1 illustrated in FIG. 3, the one or more parts of the image forming apparatus 1 are not illustrated in FIG. 5 for the sake of convenience.

The receiving part 301 (including the host I/F 205) is for receiving a printing job including image forming data. In this case, the image forming data are stored in a reception buffer of the receiving part 301. In a case where the receiving part 301 receives a printing job, the receiving part 301 reports the reception of the printing job to the image forming part 303 and the cleaning part 304.

The charging part 302 (including the charging roller 113) is for charging the conveyor belt 101 by applying an AC bias voltage (charging bias voltage) in a case of forming an image on the recording paper 108 with the image forming part 303. In a case of performing a cleaning process with the cleaning part 304, the charging part 302 reduces the AC bias voltage applied to the conveyor belt 101 for reducing the electrostatic attracting force of the conveyor belt 101.

The image forming part 303 (including, for example, the printing control part 209) is for forming an image(s) by ejecting ink droplets onto the recording paper 108 being electrostatically attracted to the conveyor belt 101.

The image forming part 303 performs an image forming process (printing process) and a post-image forming process (post-printing process). For example, in a case where the image forming apparatus 300 is an inkjet printer connected to a PC, the image forming process is a process in which image data transmitted from the PC are printed onto one or more sheets of recording paper 108. The post-image forming process is a process in which the carriage 100 is moved to a position of the protective cap 82 (cap for protecting the recording head 100*a*) and is covered (capped) by the protective cap 82 after the image forming process is completed. The belt cleaning process can be performed in the post-printing process as long as the recording head 100*a* does not contact the conveyor belt 101. Thus, the post-image forming process includes an operation of moving the carriage 100 to the position of the protective cap 82 after the printing process is completed. Further, once the post-printing process is completed, the image forming part 303 reports the completion of the post-printing process to the cleaning part 304.

The cleaning part 304 (including, for example, the cleaning blade 120) has a start condition determining part 341. In a case where the start condition determining part 341 determines that a predetermined condition(s) is satisfied, the cleaning part 304 performs the belt cleaning process. In this embodiment, the predetermined condition is when both the image forming process (printing process) and the post-image forming process (post-printing process) are completed by the image forming part 303 and no subsequent printing job is received by the receiving part 301.

<Operation>

Figure 6:
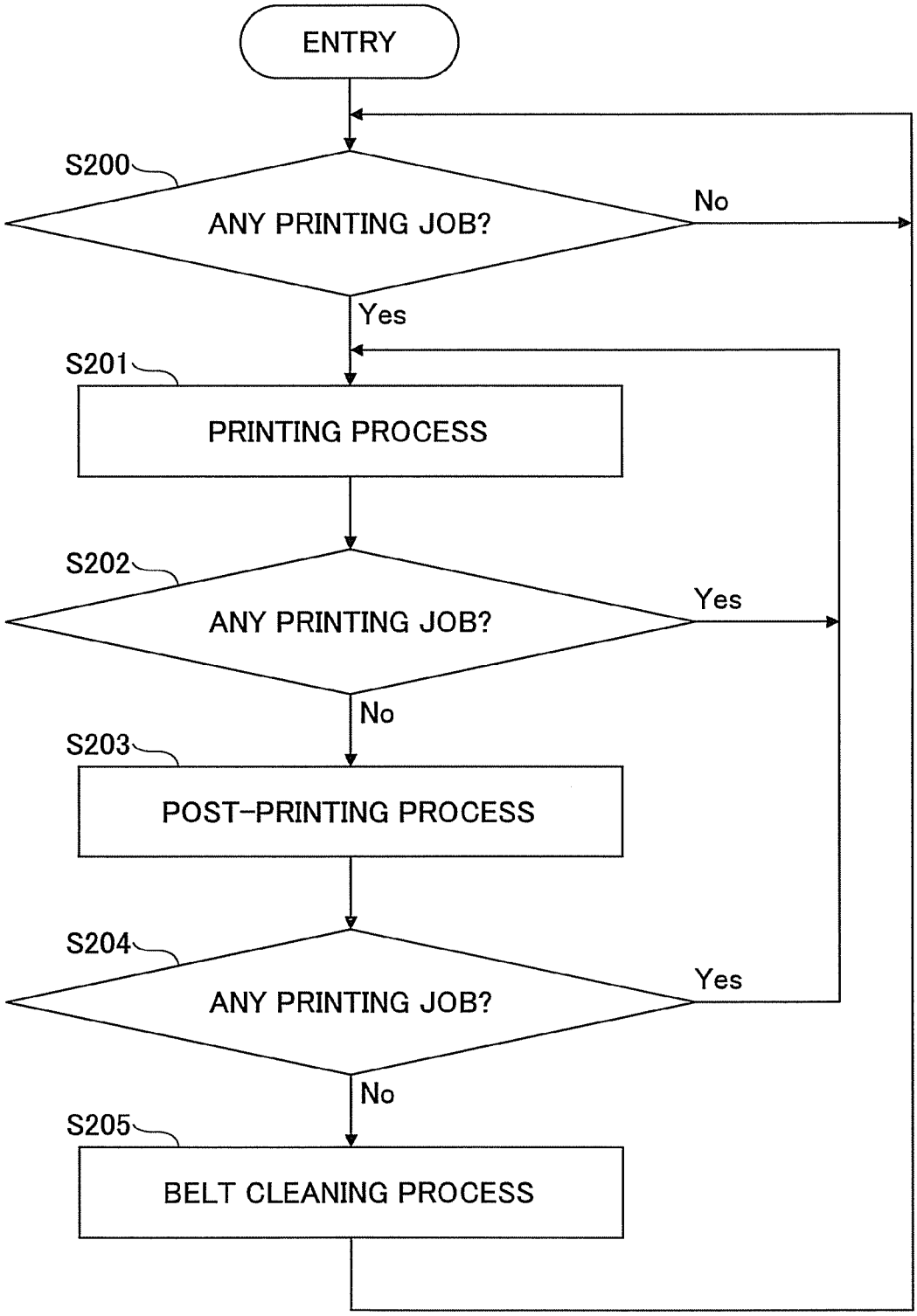
FIG. 6 is a flowchart illustrating an example of an image forming process and a belt cleaning process according to the first embodiment of the present invention.

Next, an operation of the image forming apparatus 300 according to the first embodiment of the present invention is described. FIG. 6 is a flowchart illustrating an example of an image forming process and a belt cleaning process according to the first embodiment. In Step S200, the receiving part 301 determines whether a printing job has been received. In a case where a printing job has been received by the receiving part 301 in Step S200, the operation proceeds to Step S201.

In Step S201, the image forming part 303 performs a printing process on recording paper 108 conveyed by the conveyor belt 101 charged by the charging part 302. In Step S202, the image forming part 303 determines whether another printing job has been received by the receiving part 301. In a case where the result of the determination of Step S202 is "Yes" (i.e. another printing job received), the operation returns to Step S201. In a case where the result of the determination of Step S202 is "No" (i.e. no printing job received), the operation proceeds to Step S203.

In Step S203, the image forming part 303 performs the post-printing process. After the post-printing process is completed, the image forming part 303 reports the completion of the post-printing process to the cleaning part 304.

In Step S204, the start condition determining part 341 determines whether another printing job has been received by the receiving part 301. In a case where the result of the determination of Step S204 is "Yes" (i.e. another printing job received), the operation returns to Step S201. In a case where the result of the determination of Step S204 is "No" (i.e. no printing job received), the operation proceeds to Step S205. That is, the start condition determining part 341 obtains a report of the completion of the image forming process from the image forming part 303 and determines whether a printing job has been received by the receiving part 301.

In Step S205, the cleaning part 304 performs the belt cleaning process. After the belt cleaning process is completed, the operation returns to Step S200.

Figure 7:
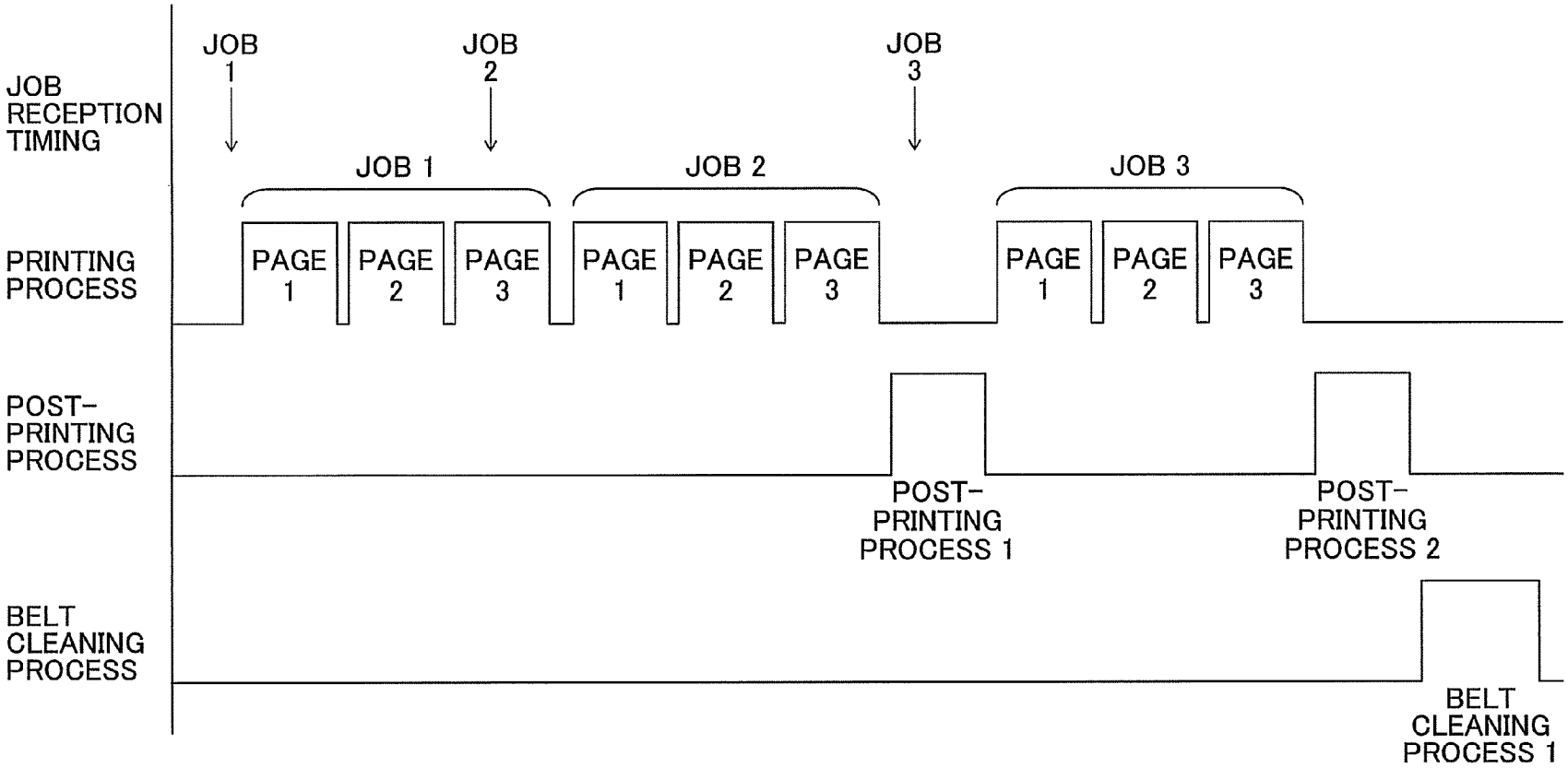
FIG. 7 illustrates an exemplary timing chart of an image forming process and a belt cleaning process according to the first embodiment of the present invention.

Next, the image forming process and the belt cleaning process of the first embodiment are described with reference to FIG. 7. FIG. 7 illustrates an exemplary timing chart of the image forming process and the belt cleaning process according to the first embodiment.

In the example illustrated in FIG. 7, because the receiving part 301 has received job 1, the image forming part 303 performs a printing process of job 1. Then, because the receiving part 301 has received job 2 during the printing process of job 1, the image forming part 303 successively performs a printing process of job 2 after the printing process of job 1 is completed.

Because no subsequent printing job has been received by the receiving part 301 during the printing process of job 2, the image forming part 303 performs a post-printing process 1. Then, because the receiving part 301 has received job 3 during the post-printing process 1, the image forming part 303 performs a printing process of job 3 after the post-printing process is completed. Then, because no subsequent printing job has been received by the receiving part 301 during the printing process of job 3, the image forming part 303 performs a post-printing process 2.

Then, because no subsequent printing job has been received by the receiving part 301 during the post-printing process 2, the cleaning part 304 performs a belt cleaning process 1 after the post-printing process is completed.

Hence, according to the first embodiment, in a case where a subsequent job is received prior to starting a belt cleaning process, a printing process of the subsequent job is performed without performing the belt cleaning process. Thereby, the user can avoid having to wait for the belt cleaning process to be completed before the printing job is started.

[Second Embodiment]

Next, an image forming apparatus according to a second embodiment of the present invention is described. According to the second embodiment, the belt cleaning process is started in a case where the number of printed pages (number of recording papers 108 on which an image(s) is formed) becomes equal to or greater than a predetermined value.

<Function Configuration>

Figure 8:
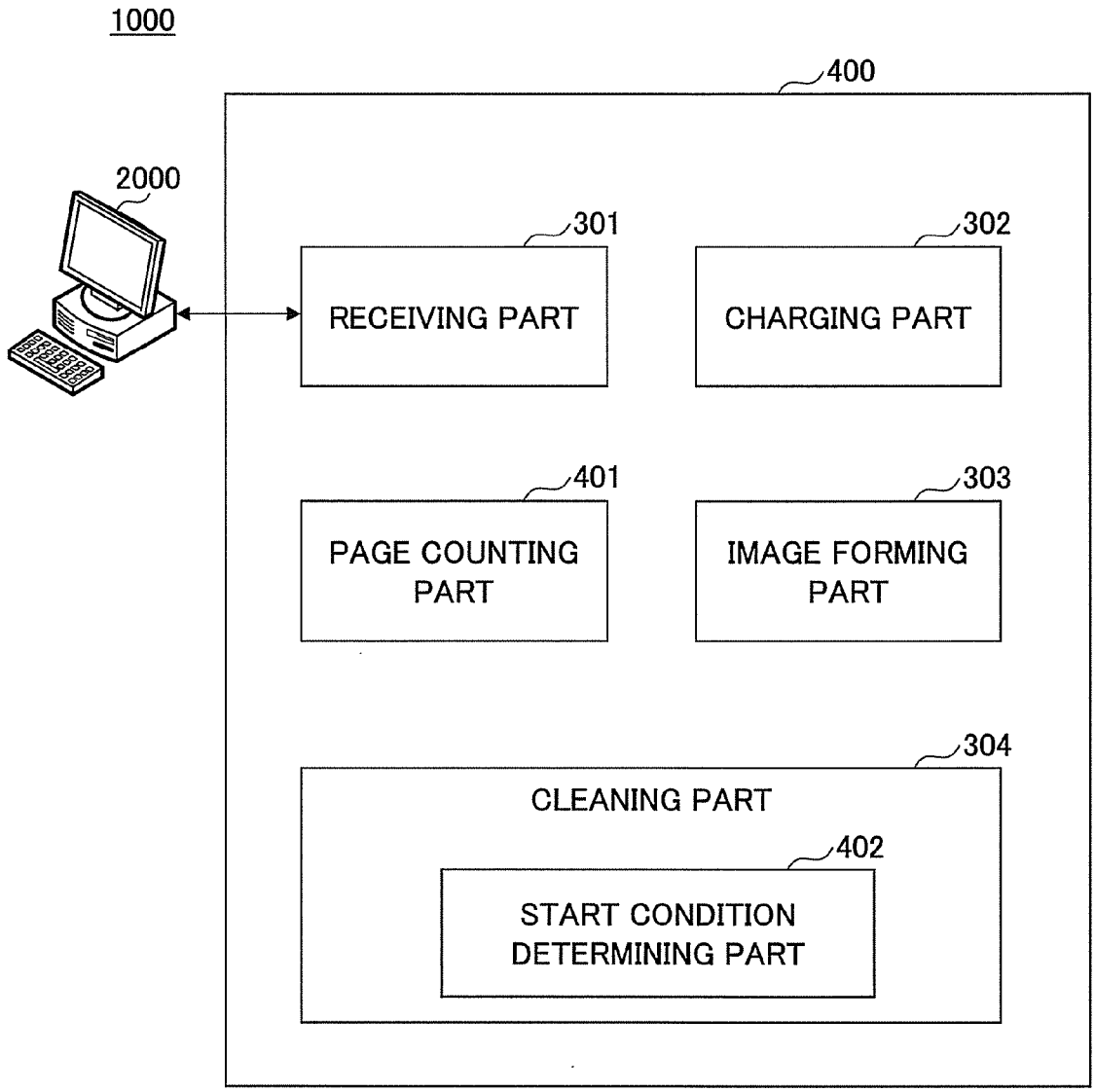
FIG. 8 is a block diagram illustrating a configuration for describing functions of an image forming apparatus according to a second embodiment of the present invention.

FIG. 8 is a block diagram illustrating a configuration for describing functions of an image forming apparatus 400 according to the second embodiment of the present invention. As illustrated in FIG. 8, the image forming apparatus 400 includes a receiving part 301, a charging part 302, an image forming part 303, a page counting part 401 and a cleaning part 304. Although the image forming apparatus 400 also includes one or more parts (e.g., CPU 201) of the image forming apparatus 1 illustrated in FIG. 3, the one or more parts of the image forming apparatus 1 are not illustrated in FIG. 8 for the sake of convenience. Further, in the second embodiment, like components/parts are denoted with like reference numerals as those of the first embodiment and are not further explained.

The page counting part 401 counts the number of sheets (pages) of recording paper 108 on which an image(s) is formed and adds the counted value to the number of previously accumulated printed pages. Further, the page counting part 401 reports the updated number of accumulated printed pages to the cleaning part 304. Further, the number of accumulated printed pages is reset after the belt cleaning process is performed.

The number of accumulated printed pages may be weighted according to the type of recording paper 108 used for printing (image forming). By changing the number of accumulated printed pages according to the type of recording paper 108, the frequency for performing the belt cleaning process may be changed. For example, in a case where the recording paper 108 is recycled paper, paper particles tend to be generated whereas paper particles are less likely to be generated in a case where the recording paper 108 is glossy paper. Accordingly, the number of accumulated printed pages is calculated by weighting the number of accumulated printed pages according to the likelihood of generating paper particles. The following Formula (1) is for calculating the number of accumulated printed pages that are weighted according to the type of recording paper 108.

$$V=\Sigma(Wi\times Vi) \qquad \text{[Formula (1)]}$$

In Formula (1), "V" represents the total number of accumulated printed pages, "Wi" represents the weighting coefficient with respect to the type of recording paper 108, and "Vi" represents the number of printed pages for the corresponding type of recording paper. By weighting the number of printed pages according to the type of recording paper 108, the belt cleaning process can be performed at a more suitable timing. Accordingly, the belt cleaning process can be prevented from being performed more than necessary. This also allows the belt cleaning process to be performed where there is a decrease of electrostatic attracting force.

For example, the weighting coefficient may be a fixed value in correspondence with the type of recording paper 108. The fixed value may be set in correspondence with the area (destination) in which the recording paper 108 or the image forming apparatus 1 is shipped. The fixed value may be automatically adjusted according to the environment (e.g., humidity obtained by a humidity sensor installed in the image forming apparatus 1) of the image forming apparatus 1. The user may set the weighting coefficient in correspondence with the user's environment. Thereby, the belt cleaning process can be performed more appropriately.

Although this embodiment starts performing the belt cleaning process based on the number of accumulated printed pages, the belt cleaning process may be started based on the accumulated printed length obtained by measuring the recording paper 108 in the sub-scanning direction.

The start condition determining part 402 of the cleaning part 304 determines whether the number of accumulated printed pages reported from the page counting part 401 is equal to or greater than a predetermined value. In a case where the number of accumulated printed pages is equal to or greater than the predetermined value, the cleaning part 304 starts the belt cleaning process.

<Operation>

Figure 9:
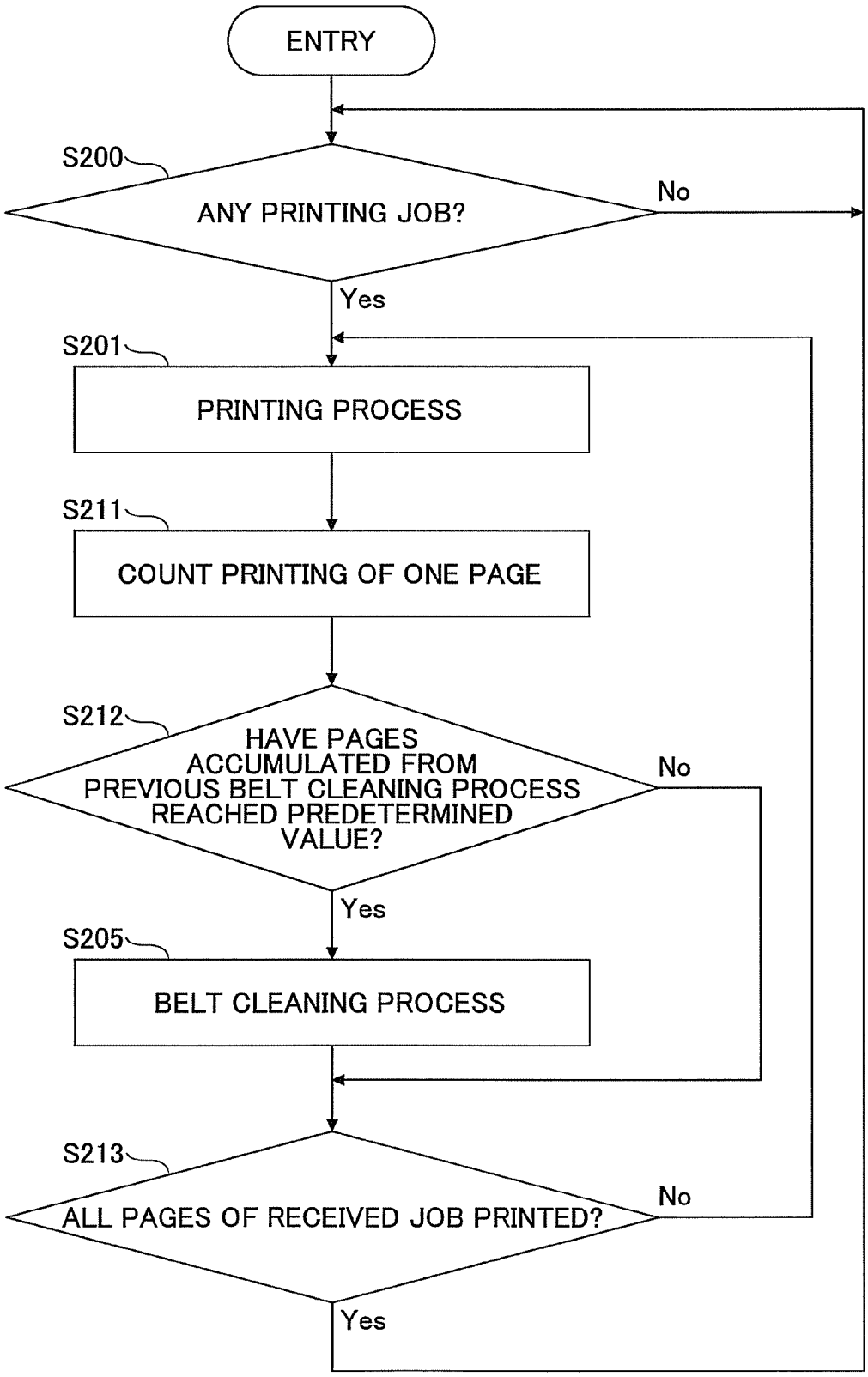
FIG. 9 is a flowchart illustrating an example of an image forming process and a belt cleaning process according to the second embodiment of the present invention.

Next, an operation of the image forming apparatus 400 according to the second embodiment of the present invention is described. FIG. 9 is a flowchart illustrating an example of an image forming process and a belt cleaning process according to the second embodiment. In FIG. 9, like components/parts and steps are denoted with like reference numerals as those of FIG. 6 of the first embodiment and are not further explained.

In Step S211, in a case where a single sheet (page) of recording paper 108 is printed by the image forming part 303, the page counting part 401 counts the printed page, adds the counted value to the number of accumulated printed pages, and reports the number of accumulated printed pages to the start condition determining part 402.

In Step S212, the start condition determining part 402 determines whether the reported number of accumulated printed pages is equal to or greater than a predetermined value. In a case where the result of the determination of Step S212 is "Yes" (i.e. equal to or greater than the predetermined value), the operation proceeds to Step S205. In a case where the result of the determination of Step S212 is "No" (i.e. less than the predetermined value), the operation proceeds to Step S213.

In Step S213, the image forming part 303 determines whether all of the pages of the received printing job having been printed. In a case where the result of the determination of Step S213 is "No" (i.e. printing process not completed), the operation returns to Step S211. In a case where the result of the determination of Step S211 is "Yes" (i.e. printing process completed), the operation returns to Step S200.

Figure 10:
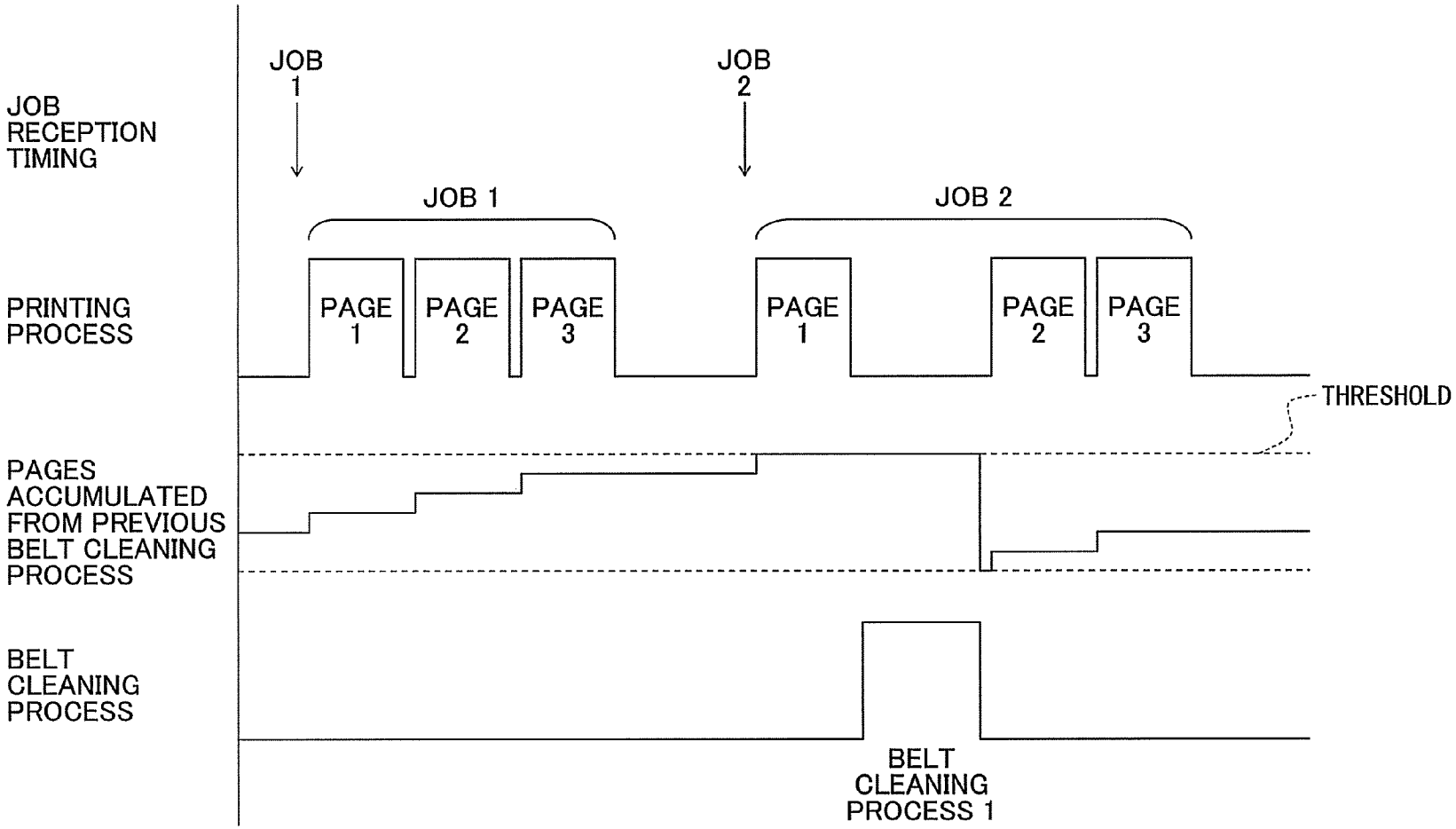
FIG. 10 illustrates an exemplary timing chart of an image forming process and a belt cleaning process according to the second embodiment of the present invention.

Next, the image forming process and the belt cleaning process of the second embodiment are described with reference to FIG. 10. FIG. 10 illustrates an exemplary timing chart of the image forming process and the belt cleaning process according to the second embodiment.

In the example illustrated in FIG. 10, because the receiving part 301 has received job 1, the image forming part 303 performs a printing process of job 1. In this example, job 1 is printing three pages. Because the number of printed pages accumulated from a previous belt cleaning process has not reached a threshold during the printing process of job 1 (printing of three pages), the cleaning part 304 neither starts the belt cleaning process during the printing process of job 1 nor after the completion of the printing process of job 1.

Then, because the receiving part 301 has received job 2, the image forming part 303 performs the printing process of job 2. Then, because the start condition determining part 402 determines that the number of printed pages accumulated from the previous belt cleaning process has reached the threshold value during the time of printing the first page of job 2, the cleaning part 304 starts the belt cleaning process 1.

Then, after the belt cleaning process 1 is completed, the image forming part 303 resumes the printing process of job 2 from the second page.

Accordingly, the number of pages to be printed until starting the belt cleaning process can be controlled. Further, in a case where the number of pages to be printed for a single job is small, the belt cleaning process can be prevented from being performed each time the printing process is completed. Accordingly, noise and waste of electric power caused by performing the belt cleaning process can be reduced. Even in a case where the number of pages to be printed for a single job is large and exceeds the number of pages likely to reduce the electrostatic attracting force of the conveyor belt 101, the electrostatic attracting force of the conveyor belt 101 can be maintained because the belt cleaning process can be performed during the middle of performing a printing job.

Next, another operation of the image forming apparatus 400 according to the second embodiment of the present invention is described. In this other operation, the condition for starting the belt cleaning process of the first embodiment and the condition for starting the belt cleaning process of the second embodiment are combined. In the following first case of the other operation, the condition for starting the belt cleaning process of the first embodiment and the condition for starting the belt cleaning process of the second embodiment are both satisfied (this first case is referred to as "start condition 1").

<Operation>

Figure 11:
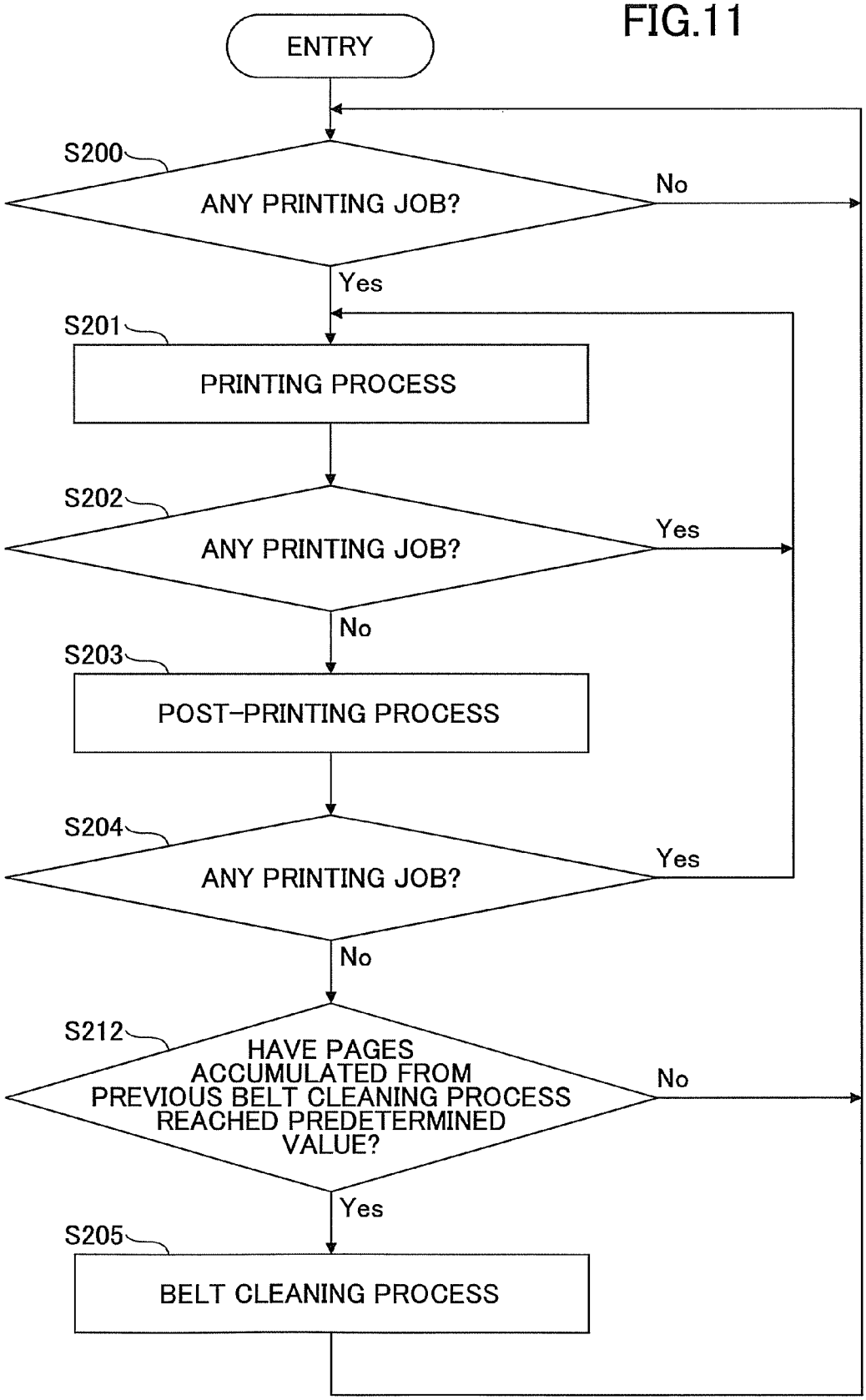
FIG. 11 is a flowchart illustrating an example of processes performed by an image forming apparatus according to an embodiment of the present invention in a case where a start condition 1 is satisfied.

FIG. 11 is a flowchart illustrating an example of processes performed by the image forming apparatus 400 in a case where the start condition 1 is satisfied (i.e. a case where the start conditions of both the first and second embodiments are satisfied). In the description of FIG. 11, like components/parts and steps are denoted with like reference numerals as those of FIGS. 6 and 9 of the first and second embodiments and are not further explained.

The content of the processes performed in the operation illustrated in FIG. 11 is substantially the same as those of the first and second embodiments. However, in Step S212 that follows Step S204, the start condition determining part 402 determines whether the number of accumulated printed pages counted by the page counting part 401 is equal to or greater than a predetermined value. In a case where the determination result in Step S212 is "Yes" (i.e. equal to or greater than the predetermined value), the belt cleaning process is started in Step S205. In a case where the determination result in Step S212 is "No" (i.e. less than the predetermined value), the operation returns to Step S200.

Figure 12:
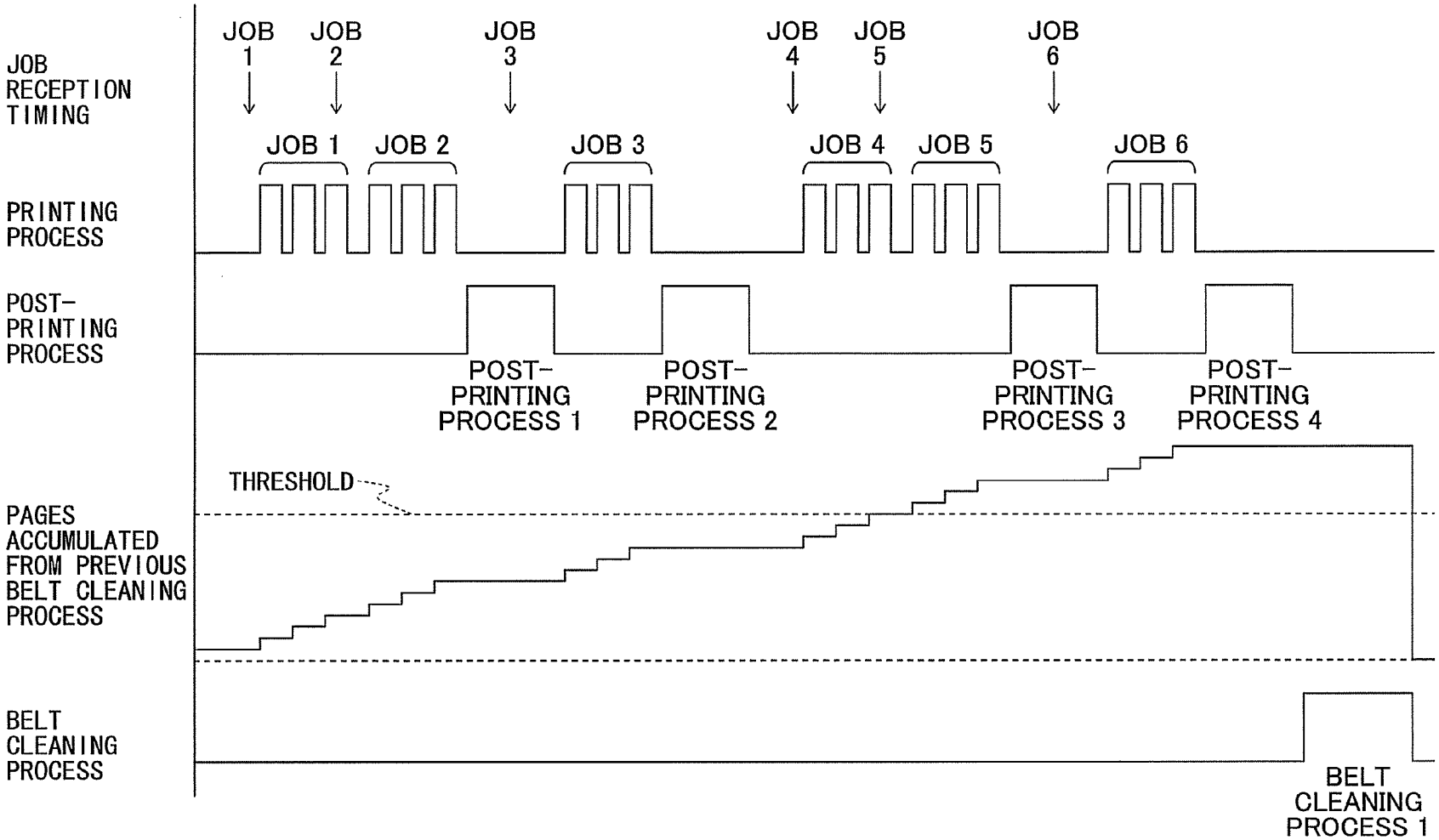
FIG. 12 illustrates an exemplary timing chart of an image forming process and a belt cleaning process of a first case according to an embodiment of the present invention.

Next, the image forming process and the belt cleaning process of the first case are described with reference to FIG. 12. FIG. 12 illustrates an exemplary timing chart of the image forming process and the belt cleaning process according to the first case (start condition 1).

As illustrated in FIG. 12, because the receiving part 301 has received job 1, the image forming part 303 performs a printing process of job 1. Then, because the receiving part 303 has received job 2 during the printing process of job 1, the image forming part 303 successively performs a printing process of job 2 after the printing process of job 1 is completed.

Because no subsequent printing job has been received by the receiving part 301 during the printing process of job 2, the image forming part 303 performs a post-printing process 1. Then, because the receiving part 301 has received job 3 during the post-printing process 1, the image forming part 303 performs a printing process of job 3 after the post-printing process 1 is completed. Then, because no subsequent printing job has been received by the receiving part 301 during the printing process of job 3, the image forming part 303 performs a post-printing process 2. Although no subsequent printing job has been received by the receiving part 301 during the post-printing process 2, if the number of printed pages accumulated from a previous belt cleaning process has not yet reached a threshold during the post-printing process 2, the cleaning part 304 does not start the belt cleaning process.

Although the printing processes of jobs 4 through 6 and the post-printing processes 3 and 4 are performed substantially in the same manner as those of jobs 1 through 3 and post-printing processes 1 and 2, the cleaning part 304 starts the belt cleaning process after the post-printing process 4 is completed because the start condition determining part 402 has determined that the number of printed pages accumulated from a previous belt cleaning process has reached the threshold (in this example, during the printing process of job 6).

Because the lowest value of the number of pages to be printed until starting the belt cleaning process can be controlled (set), in a case where the number of pages to be printed for a single job is small, the belt cleaning process can be prevented from being performed each time the printing process is completed. Accordingly, noise and waste of electric power caused by the performing of the belt cleaning process can be reduced.

Further, because a printing process of a job can be performed without performing the belt cleaning process in a case where a subsequent job is received prior to performing the belt cleaning process, the user can avoid having to wait for the belt cleaning process to be completed before the printing job is started.

Next, a second case of the other operation of the image forming apparatus 400 according to the second embodiment of the present invention is described. In the following second case of the other operation, either one of the condition for starting the belt cleaning process of the first embodiment or the condition for starting the belt cleaning process of the second embodiment is satisfied (this second case is referred to as "start condition 2").

<Operation>

Figure 13:
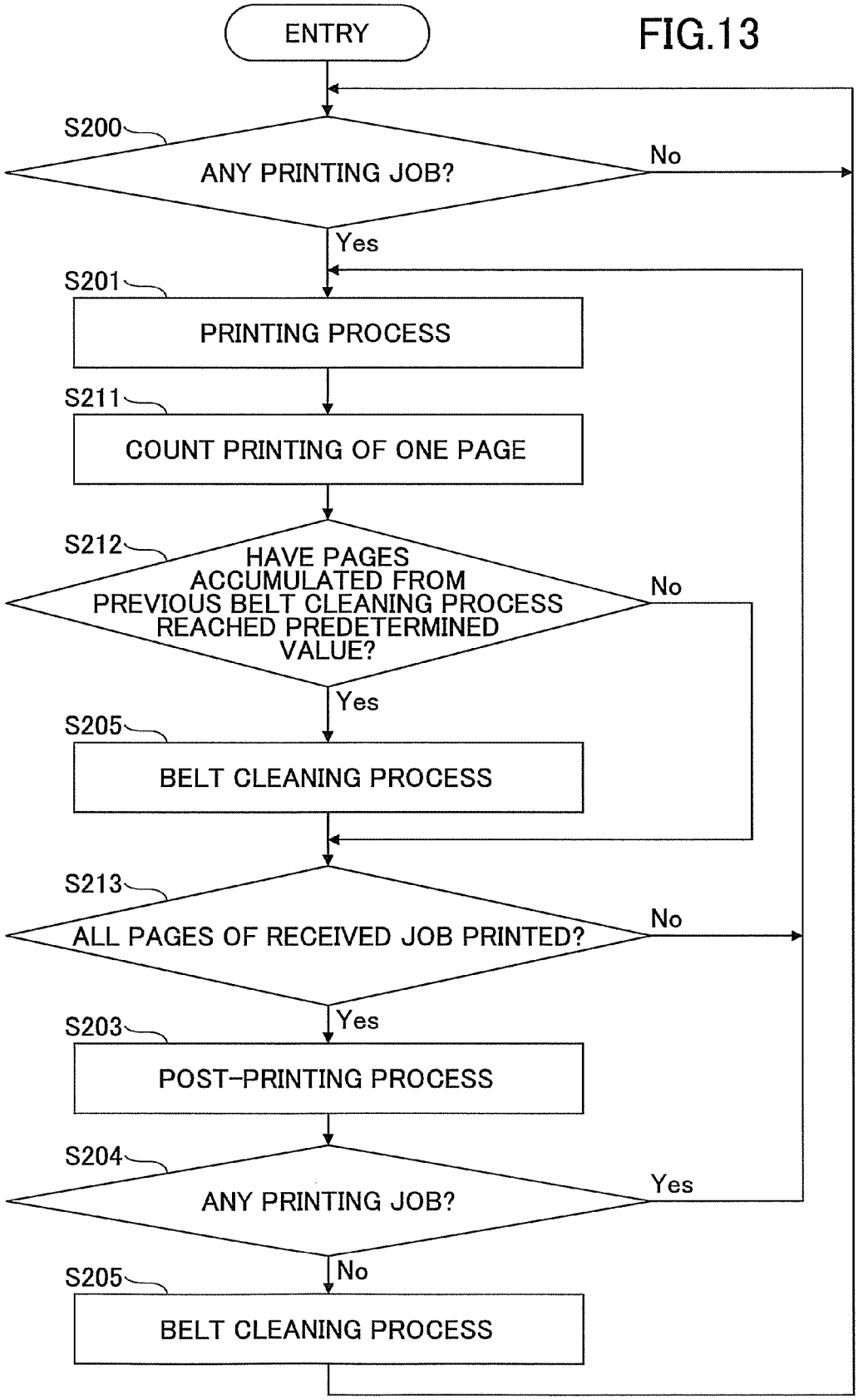
FIG. 13 is a flowchart illustrating an example of processes performed by an image forming apparatus according to an embodiment of the present invention in a case where a start condition 2 is satisfied.

FIG. 13 is a flowchart illustrating an example of processes performed by the image forming apparatus 400 in a case where the start condition 2 is satisfied (i.e. a case where either the start condition of the first embodiment or the start condition of the second embodiment is satisfied). In the description of FIG. 13, like components/parts and steps are denoted with like reference numerals as those of FIGS. 6 and 9 of the first and second embodiments and are not further explained.

The content of the processes performed in the operation illustrated in FIG. 13 is substantially the same as those of the first and second embodiments.

As illustrated in FIG. 13, the belt cleaning process is started either in a case where the number of accumulated printed pages counted by the page counting part 402 is equal to or greater than a predetermined value (Yes in Step S212) or a case where the post-printing process is completed and no subsequent printing job is received (No in Step S204).

Figure 14:
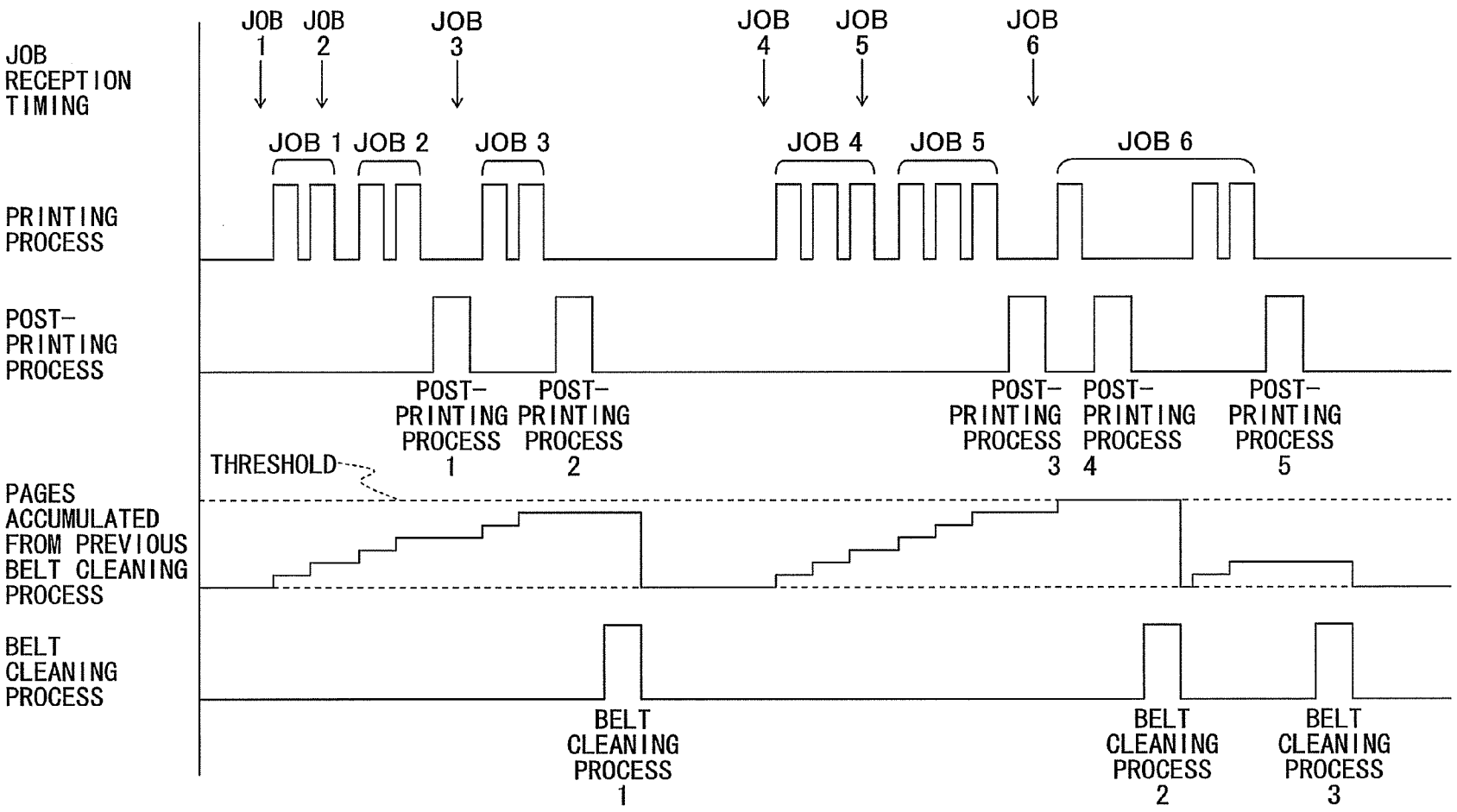
FIG. 14 illustrates an exemplary timing chart of an image forming process and a belt cleaning process of a second case according to an embodiment of the present invention.

Next, the image forming process and the belt cleaning process of the second case are described with reference to FIG. 14. FIG. 14 illustrates an exemplary timing chart of the image forming process and the belt cleaning process according to the second case (start condition 2).

As illustrated in FIG. 14, because the receiving part 301 has received job 1, the image forming part 303 performs a printing process of job 1. Then, because the receiving part 303 has received job 2 during the printing process of job 1, the image forming part 303 successively performs a printing process of job 2 after the printing process of job 1 is completed.

Because no subsequent printing job has been received by the receiving part 301 during the printing process of job 2, the image forming part 303 performs a post-printing process 1. Then, because the receiving part 301 has received job 3 during the post-printing process 1, the image forming part 303 performs a printing process of job 3 after the post-printing process 1 is completed.

Then, because no printing job has been received by the receiving part 301 during the printing process of job 3, the image forming part 303 performs a post-printing process 2. Because the start condition determining part 402 determines that the number of printed pages accumulated from a previous belt cleaning process has not yet reached a threshold during the printing processes of jobs 1 through 3, the cleaning part 304 does not start the belt cleaning process.

Then, because no subsequent printing job has been received by the receiving part 301 during the post-printing process 2, the cleaning part 304 starts a belt cleaning process 1 after the post-printing process 2 is completed.

Then, because the receiving part 301 has received job 4, the image forming part 303 performs a printing process of job 4. Then, because the receiving part 303 has received job 5 during the printing process of job 4, the image forming part 303 successively performs a printing process of job 5 after the printing process of job 4 is completed.

Because no subsequent printing job has been received by the receiving part 301 during the printing process of job 5, the image forming part 303 performs a post-printing process 3. Then, because the receiving part 301 has received job 6 during the post-printing process 3, the image forming part 303 performs a printing process of job 6 after the post-printing process 3 is completed.

Because the start condition determining part 402 determines that the number of printed pages accumulated since a previous belt cleaning process has reached a threshold during the printing process of job 6, the image forming part 303 starts the post-printing process 4. Then, the cleaning part 304 starts a belt cleaning process 2.

Then, the image forming part 303 resumes the remaining printing process of job 6 after the belt cleaning process 2 is completed. Then, because no subsequent printing job has been received by the receiving part 301 during the printing process of job 6, the image forming part 303 performs a post-printing process 5.

Then, because no printing job has been received by the receiving part 301 during the post-printing process 5, the cleaning part 304 starts a belt cleaning process 3 after the post-printing process 5 is completed.

Accordingly, in a case where a subsequent job is received prior to starting a belt cleaning process, a printing process of the subsequent job is performed without performing the belt cleaning process. Thereby, the user can avoid having to wait for the belt cleaning process to be completed before the printing job is started.

Further, because the least number of pages to be printed until the belt cleaning process can be controlled (set), even in a case where the number of pages to be printed for a single job is large and exceeds the number of pages likely to reduce the electrostatic attracting force of the conveyor belt 101, the electrostatic attracting force of the conveyor belt 101 can be maintained because the belt cleaning process is performed during the middle of performing a printing job.

[Third Embodiment]

Next, an image forming apparatus 500 according to a third embodiment of the present invention is described. According to the third embodiment, the belt cleaning process is started in a case where opening of a cover 3000 (an outer part of the image forming apparatus as illustrated in FIGS. 1 and 4) is detected.

<Function Configuration>

Figure 15:
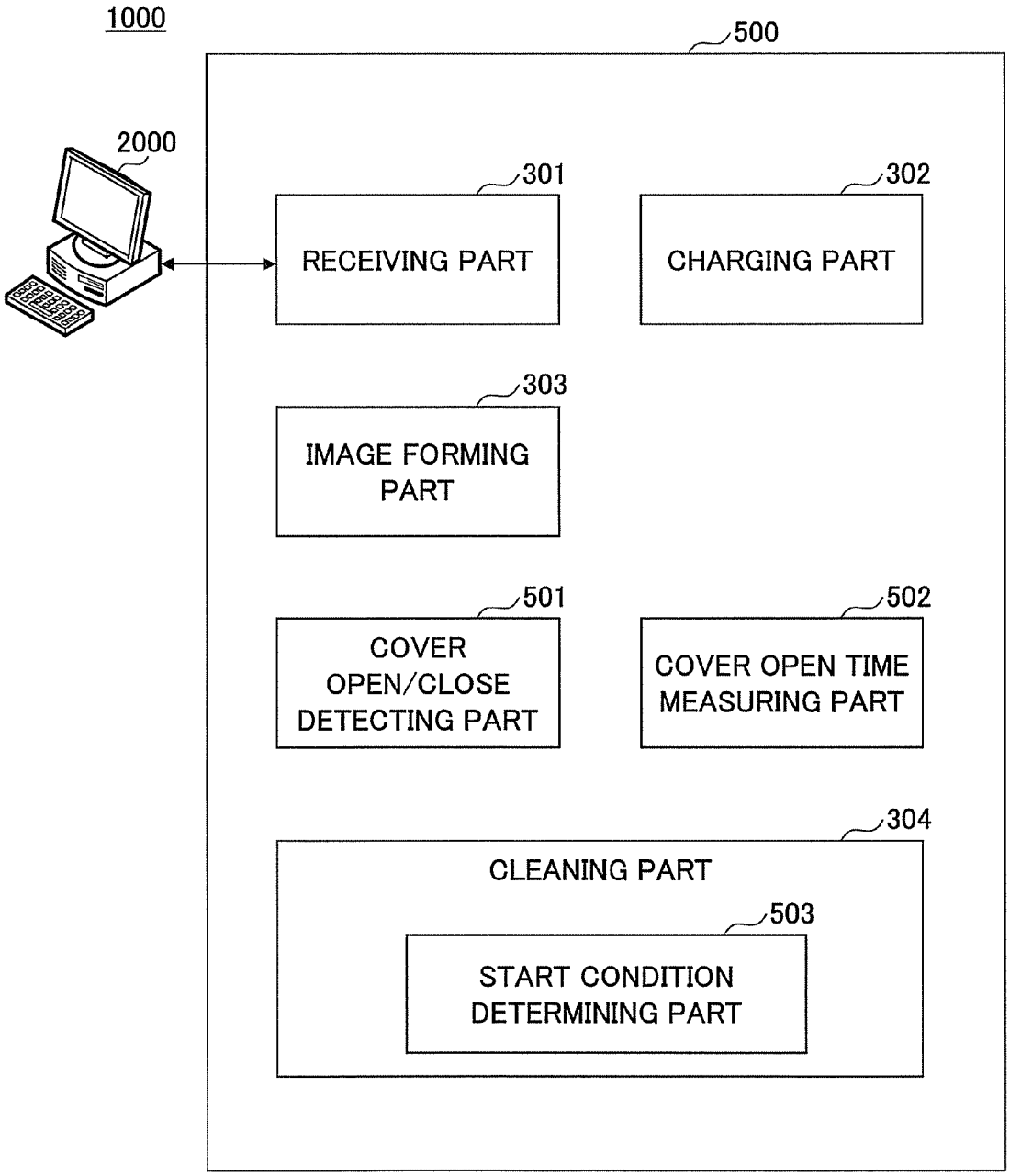
FIG. 15 is a block diagram illustrating a configuration for describing functions of an image forming apparatus according to a third embodiment of the present invention.

FIG. 15 is a block diagram illustrating a configuration for describing functions of the image forming apparatus 500 according to the third embodiment of the present invention. As illustrated in FIG. 15, the image forming apparatus 500 includes a receiving part 301, a charging part 302, an image forming part 303, a cover open/close detecting part 501, and a cleaning part 304. As described below, the image forming apparatus 500 may also include a cover open time measuring part 502. Although the image forming apparatus 500 also includes one or more parts (e.g., CPU 201) of the image forming apparatus 1 illustrated in FIG. 3, the one or more parts of the image forming apparatus 1 are not illustrated in FIG. 15 for the sake of convenience. Further, in the third embodiment, like components/parts are denoted with like reference numerals as those of the first and second embodiments and are not further explained.

The cover open/close detecting part 501 is for detecting the opening and closing of a cover 3000 formed on the outside of the image forming apparatus 500. The cover is for covering the inside of the image forming apparatus 500. In a case where the cover open/close detecting part 501 detects the opening or closing of the cover 3000, the cover open/close detecting part 501 reports the opening/closing of the cover 3000 to the image forming part 303 and the cleaning part 304. In a case where the image forming apparatus 500 includes the cover open time measuring part 502, the cover open/close detecting part 501 reports the opening/closing of the cover 3000 to the cover open time measuring part 502 instead the cleaning part 304.

The cover open time measuring part 502 is for measuring the length of time the cover 3000 is opened (hereinafter also referred to as "open time") from the time when the opening of the cover 3000 is reported by the cover open/close detecting part 501. When the closing of the cover 3000 is reported to the cover open time measuring part 502, the cover open time measuring part 502 stops measuring the open time, adds the measured open time to an accumulated cover open time, and outputs the accumulated cover open time including the measured open time to the cleaning part 304. It is to be noted that the accumulated cover open time is reset when the belt cleaning process is started.

Next, the start condition determining part 503 of the cleaning part 304 is described. The processes performed by the start condition determining part 503 differ depending on whether the image forming apparatus 500 includes the open time measuring part 502. The following first example of the start condition determining part 503 is described in a case where no open time measuring part 502 is included in the image forming apparatus 500.

(Case where the open time measuring part 502 is not included)

When the start condition determining part 503 receives a report that the cover 3000 has been opened by the cover open/close detecting part 501 and then receives a report that the cover 3000 has been closed by the cover open/close detecting part 501, the start condition determining part 503 determines that the condition for starting the belt cleaning process is satisfied. Accordingly, when the cover 3000 is closed after the cover 3000 is opened, the cleaning part 304 starts the belt cleaning process.

In other words, the start condition of the belt cleaning process is the closing of the cover 3000 after the cover 3000 is opened.

<Operation>

Figure 16:
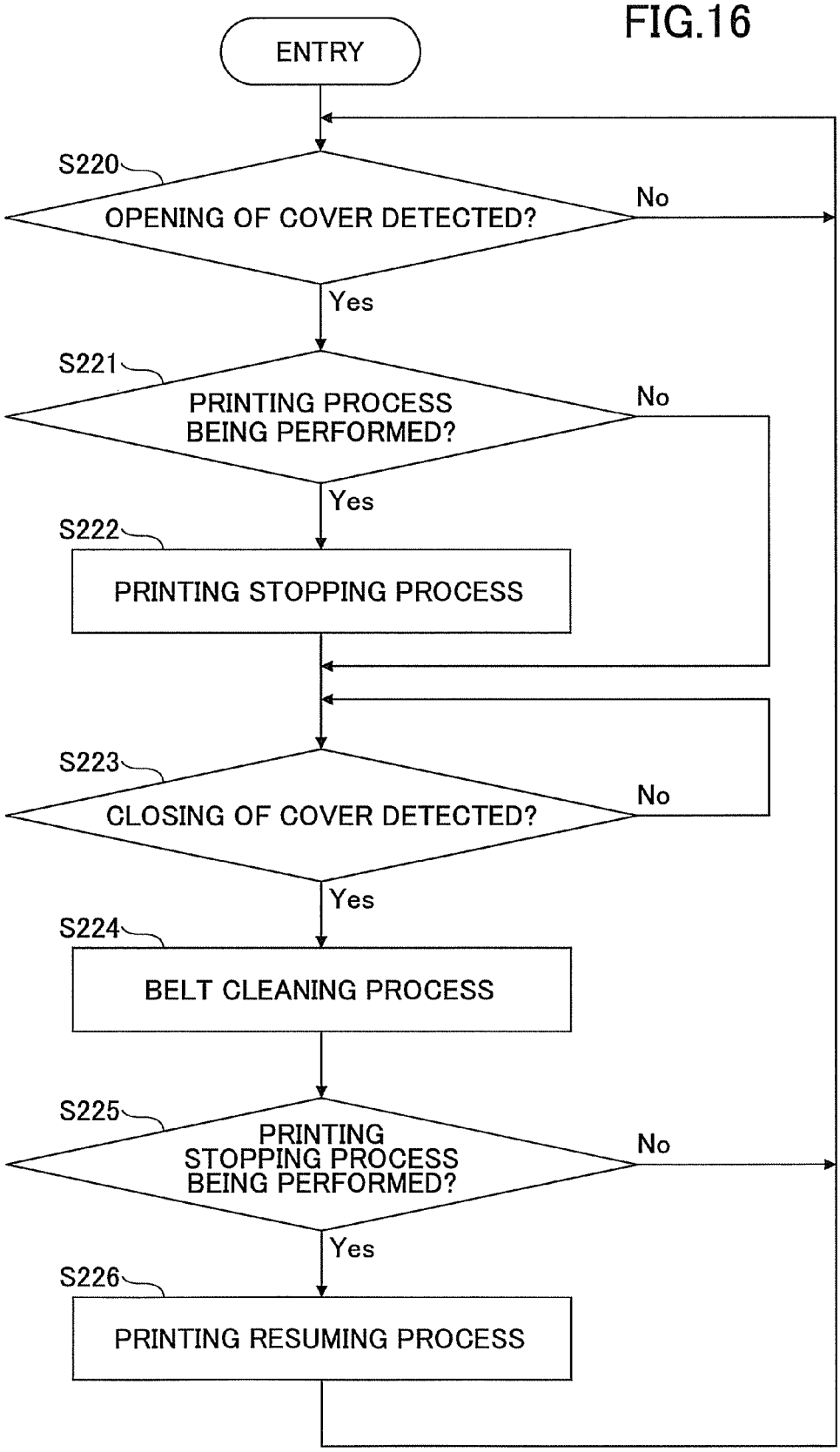
FIG. 16 is a flowchart illustrating a first example of an image forming process and a belt cleaning process according to the third embodiment of the present invention.

FIG. 16 is a flowchart illustrating a first example of an image forming process and a belt cleaning process according to the third embodiment. In Step S220, the cover open/close detecting part 501 determines whether the cover 3000 has been opened. In a case where the result of the determination of Step S220 is "Yes" (i.e. cover open detected), the operation proceeds to Step S221. In a case where the result of the determination of Step S220 is "No" (i.e. cover open undetected), the operation returns to Step S220.

In Step S221, the image forming part 303 determines whether a printing process is being performed when receiving a report from the cover open/close detecting part 501 that the cover 3000 is opened. In a case where the result of the determination of Step S221 is "Yes" (i.e. printing process being performed), the operation proceeds to Step S222. In a case where the result of the determination of Step S221 is "No" (i.e. printing process not being performed), the operation proceeds to Step 223. In Step S222, the image processing part 303 stops the printing process being performed (hereinafter also referred to as "printing stopping process").

In Step S223, the cover open/close detecting part 501 determines whether the cover 3000 is closed. In a case where the result of the determination of Step S223 is "Yes" (cover closed detected), the operation proceeds to Step S224. In a case where the result of the determination of Step S223 is "No" (cover closed undetected), the operation returns to Step S223.

In Step S224, the start condition determining part 503 determines that the start condition (cover opened→cover closed) is satisfied and reports that the start condition is satisfied to the cleaning part 304. When the cleaning part 304 receives the report from the start condition determining part 503, the cleaning part 304 starts the belt cleaning process.

In Step S225, the image forming part 303 determines whether the printing process is being stopped (i.e. whether the printing stopping process is being performed). In a case where the result of the determination of Step S225 is "Yes" (i.e. printing process being stopped), the operation proceeds to Step S226. In a case where the result of the determination of Step S225 is "No" (i.e. printing process not being stopped), the operation returns to Step 220.

In Step S226, the image forming part 303 resumes the stopped printing process (hereinafter also referred to as "printing resuming process"). After the printing process is resumed, the operation returns to Step S220.

Figure 17:
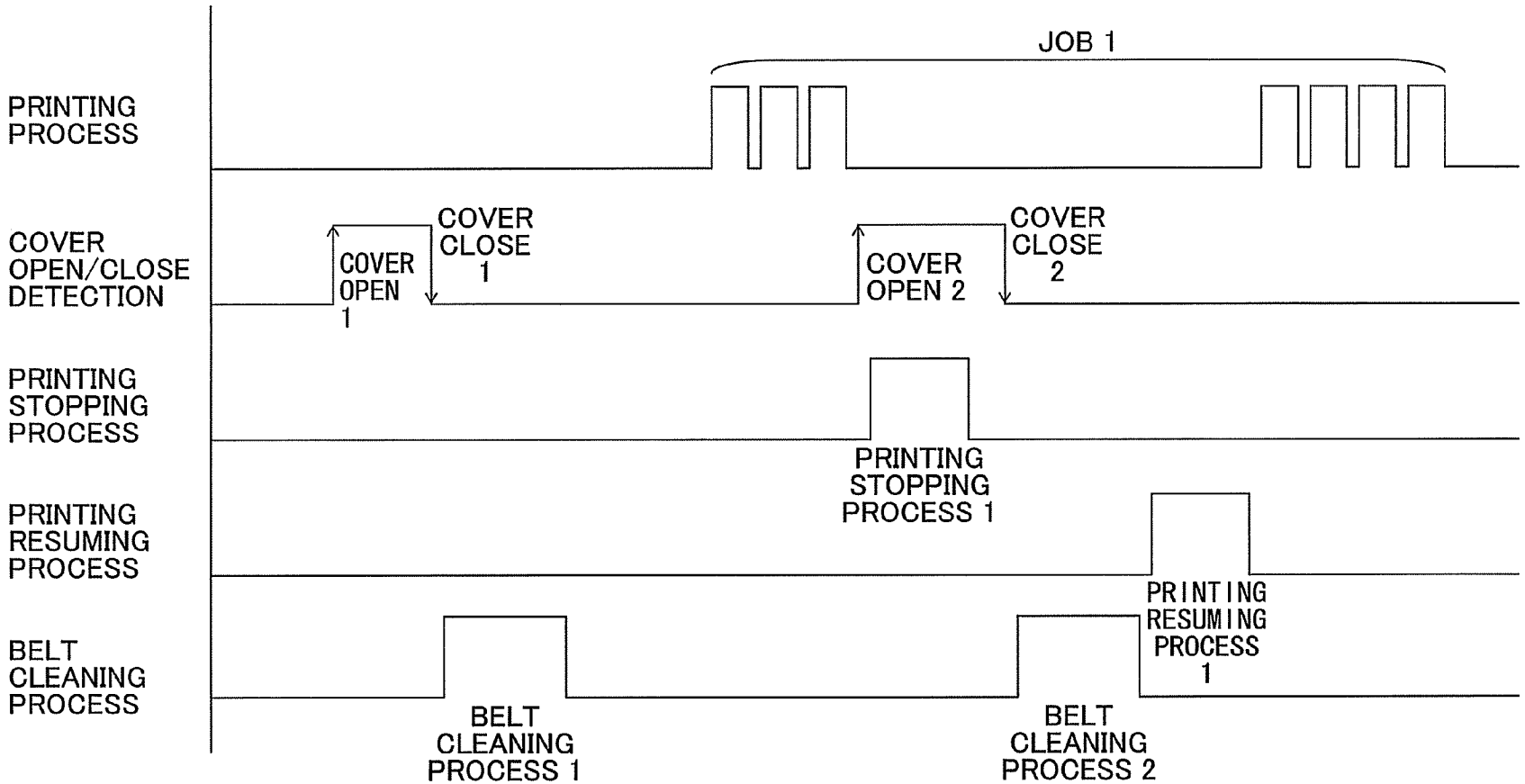
FIG. 17 illustrates a first exemplary timing chart of an image forming process and a belt cleaning process according to the third embodiment of the present invention.

Next, a first example of the image forming process and the belt cleaning process according to the third embodiment is described with reference to FIG. 17. FIG. 17 illustrates a first exemplary timing chart of the image forming process and the belt cleaning process according to the third embodiment.

First, the cover open/close detecting part 501 detects cover opening 1 when the printing operation is not being performed. Then, when the cover open/close detecting part detects cover closing 1, the cleaning part 304 starts a belt cleaning process 1 because the printing process is not being performed.

Then, the image forming part 303 performs a printing process of job 1. When the cover open/close detecting part 501 detects cover opening 2 during the printing process of job 1, the image forming part 303 performs a printing stopping process 1 because the printing process of job 1 is being performed. Then, when the cover open/close detecting part 501 detects cover closing 2, the cleaning part 304 starts a belt cleaning process 2. After the belt cleaning process 2 is completed, the image forming part 303 performs a printing resuming process 1 for performing the remaining printing process of job 1.

It is to be noted that not only foreign matter such as paper particles may adhere to the conveyor belt 101 by the conveying of the recording paper 108 but also particles (dust) floating in the atmosphere may adhere to the conveyor belt 101 due to the opening and closing of the cover 3000. However, with the above-described embodiment, even in a case where the conveyor belt 101 becomes exposed to the outside by the opening/closing of the cover 3000 and has dust adhered to it, the belt cleaning process can be appropriately performed while maintaining the electrostatic attracting force.

(Case where the open time measuring part 502 is included)

The following second example of the start condition determining part 503 is described in a case where the open time measuring part 502 is included in the image forming apparatus 500. When the start condition determining part 503 receives a report of accumulated cover open time from the open time measuring part 502, the start condition determining part 503 determines whether the reported accumulated cover open time is equal to or greater than a predetermined value. In a case where the accumulated cover open time is equal to or greater than the predetermined value, the start condition determining part 503 determines that the condition for starting the belt cleaning process is satisfied. Accordingly, the start condition determining part 503 instructs the cleaning part 304 to start the belt cleaning process. In a case where the accumulated cover open time is less than the predetermined value, the start condition determining part 503 determines that the condition for starting the belt cleaning process is not satisfied. In other words, the start condition of the belt cleaning process is when the time accumulated from the opening of the cover 3000 becomes equal to or greater than a predetermined value.

<Operation>

Figure 18:
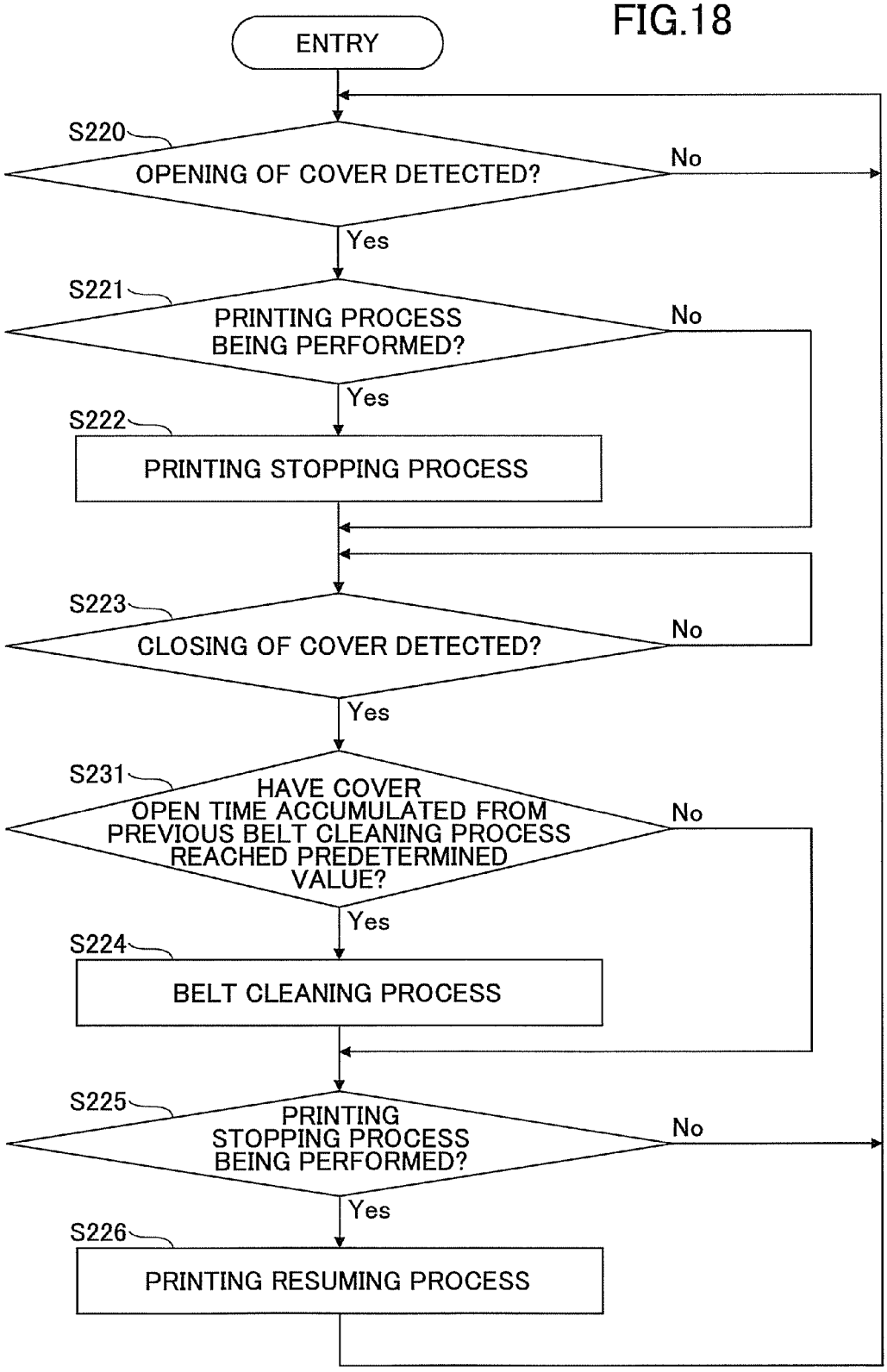
FIG. 18 is a flowchart illustrating a second example of an image forming process and a belt cleaning process according to the third embodiment of the present invention.

FIG. 18 is a flowchart illustrating a second example of an image forming process and a belt cleaning process according to the third embodiment. In FIG. 18, like components/parts and steps are denoted with like reference numerals as those of FIG. 16 of the first example of the third embodiment and are not further explained.

In Step S223, after the opening of the cover 3000 is detected by the cover open/close detecting part 501 (description of Steps S221-223 omitted), the start condition determining part 503 determines whether the cover open time accumulated (elapsed) from the previous belt cleaning process is equal to or greater than a predetermined value.

In a case where the result of the determination of Step S231 is "Yes" (i.e. equal to or greater than predetermined value), the cleaning part 304 starts the belt cleaning process. In a case where the result of the determination of Step S231 is "No" (i.e. less than predetermined value), the belt cleaning process is not performed and the operation proceeds to Step S225.

Figure 19:
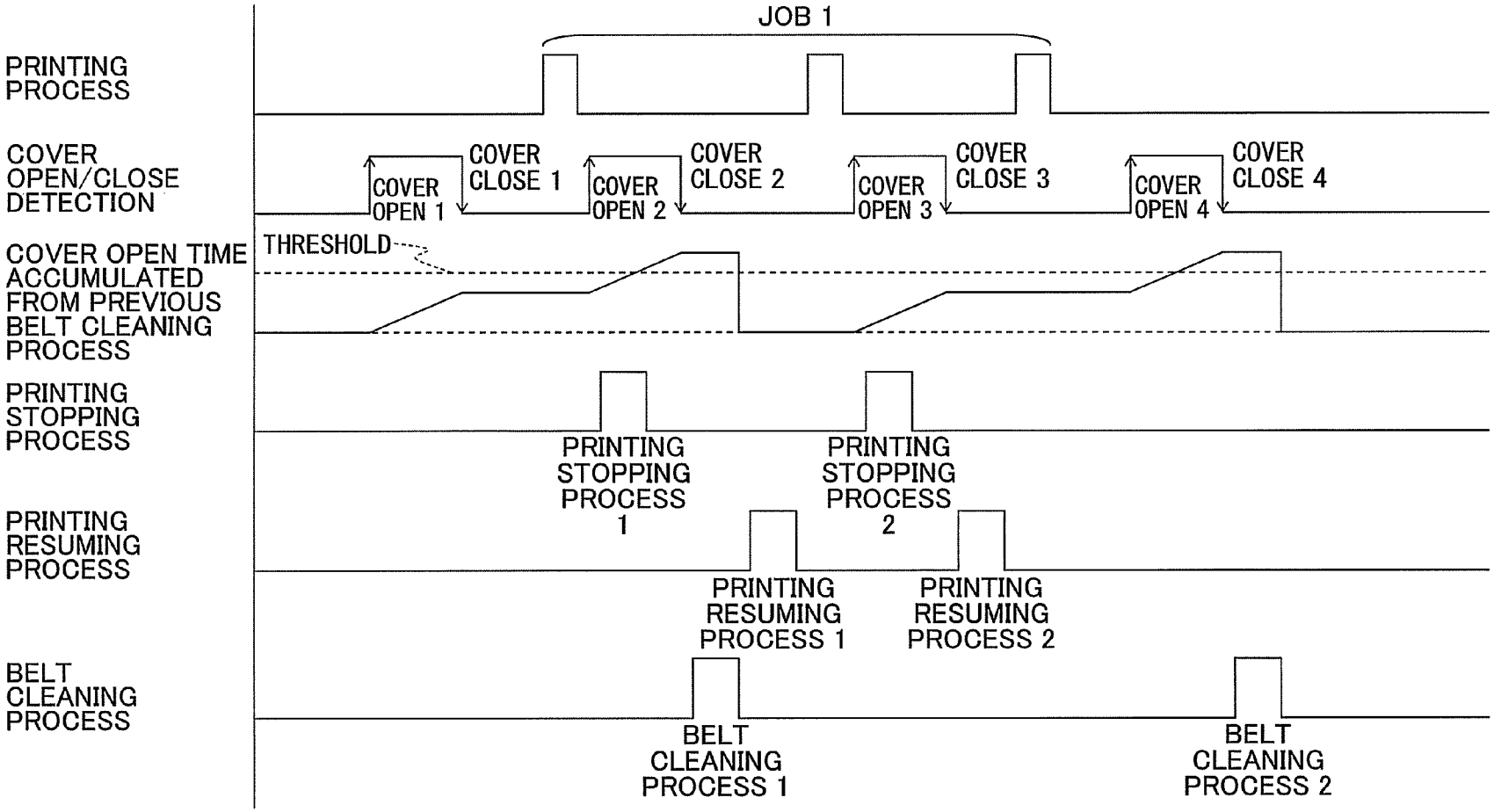
FIG. 19 illustrates a second exemplary timing chart of an image forming process and a belt cleaning process according to the third embodiment of the present invention.

Next, a second example of the image forming process and the belt cleaning process according to the third embodiment is described with reference to FIG. 19. FIG. 19 illustrates a second exemplary timing chart of the image forming process and the belt cleaning process according to the third embodiment.

First, the cover open/close detecting part 501 detects cover opening 1 when the printing operation is not being performed. Then, when the cover open/close detecting part 501 detects cover closing 1, the start condition determining part 503 determines that the cover open time accumulated from the previous belt cleaning process has not yet reached a threshold (predetermined value). Therefore, no belt cleaning process is performed.

Then, the image forming part 303 performs a printing process of job 1. When the cover open/close detecting part 501 detects cover opening 2 during the printing process of job 1, the image forming part 303 performs a printing stopping process 1 because the printing process of job 1 is being performed.

Then, when the cover open/close detecting part 501 detects cover closing 2, the start condition determining part 503 determines that the cover open time accumulated from the previous belt cleaning process has reached the threshold (predetermined value). Accordingly, the cleaning part 304 starts performing a belt cleaning process 1.

After the belt cleaning process 1 is completed, the image forming part 303 performs a printing resuming process 1 for performing the remaining printing process of job 1. Further, when the cover open/close detecting part 501 detects cover opening 3 during the printing process of job 1, the image forming part 303 performs the printing stopping process because the printing process of job 1 is being performed.

Then, when the cover open/close detecting part 501 detects cover closing 3, the start condition determining part 503 determines that the cover open time accumulated from the previous belt cleaning process has not yet reached the threshold (predetermined value). Accordingly, the image forming part 303 performs a printing resuming process 2 for performing the remaining printing process of job 1.

After the printing process of job 1 is completed, the cover open/close detecting part 501 detects cover opening 4 where the printing process is not being performed. Then, when the cover open/close detecting part 501 detects cover closing 4, the start condition determining part 503 determines that the cover open time accumulated from the previous belt cleaning process has reached the threshold (predetermined value). Accordingly, the cleaning part 304 starts performing a belt cleaning process 2.

Because the lowest value of the time accumulated from the previous belt cleaning process can be controlled, unnecessary belt cleaning processes can be prevented from being performed, for example, where the cover 3000 is closed after the cover 3000 is opened for only a short period of time (time of a length in which no or hardly any dust would adhere to the conveyor belt 101). Accordingly, noise and waste of electric power caused by the performing of the belt cleaning process can be reduced.

[Fourth Embodiment]

Next, an image forming apparatus 1 according to a fourth embodiment of the present invention is described. According to the fourth embodiment, the belt cleaning process is started in a case where execution of a belt cleaning process is requested by a user. In other words, the start condition of the belt cleaning process is that there is a request for execution of a belt cleaning process from a user.

<Operation>

Figure 20:
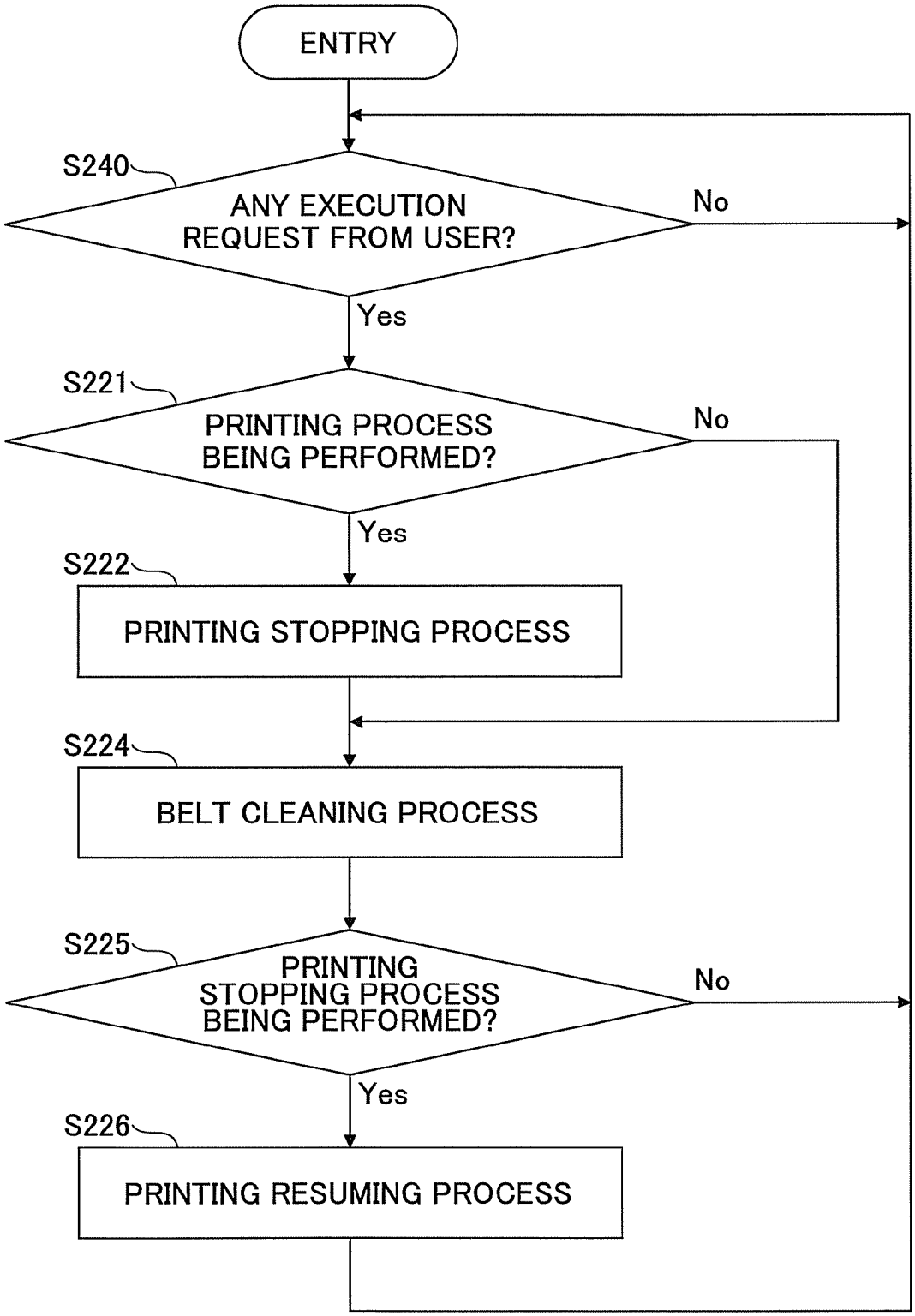
FIG. 20 is a flowchart illustrating an example of an image forming process and a belt cleaning process according to the fourth embodiment of the present invention.

FIG. 20 is a flowchart illustrating an example of an image forming process and a belt cleaning process according to the fourth embodiment. In FIG. 20, like components/parts and steps are denoted with like reference numerals as those of FIG. 16 of the first embodiment and are not further explained.

In Step S240, the CPU 201 determines whether execution of a belt cleaning process is requested from the user. The execution of the belt cleaning process may be requested from, for example, the control panel 126 of the image forming apparatus 1 (e.g., MFP, Multi-Function Peripheral) or a control part of the data processing apparatus (e.g., a PC having a printer driver displayed on a monitor of the PC) 2000 operated by the user. In a case where the result of the determination in Step S240 is "Yes" (Request received), the operation proceeds to Step S221 and the steps following Step S221 are performed.

Accordingly, in a case where the user or a maintenance service personnel notices an abnormality in the electrostatic attracting force of the conveyor belt 101, the belt cleaning process can be discretionally performed, so that recovery of the electrostatic attracting force of the conveyor belt 101 can be achieved.

The present invention is not limited to the specifically disclosed embodiments, and variations and modifications may be made without departing from the scope of the present invention.

For example, one or more of the components/parts included the above-described embodiments of the image forming apparatus 1, 300, 400, and 500 may be provided in an image forming system 1000 and/or in a data processing apparatus 2000 including the printer driver 125.

Further, the above-described processes (e.g., printing process, belt cleaning process, etc.) performed with the image forming apparatus 1, 300, 400, and 500 may be included in a program which causes the image forming apparatus 1, 300, 400, and 500 to perform the above-described processes. Further, the program may be recorded in the recording medium 127 for causing the image forming apparatus 1, 300, 400, and 500 to perform the above-described processes.

The present application is based on Japanese Priority Application No. 2009-023998 filed on Feb. 4, 2009, the entire contents of which are hereby incorporated herein by reference.

What is claimed is:

1. An image forming apparatus including a receiving part for receiving an image forming request, a conveyor belt for rotating and conveying a recording paper thereon, a charging part for applying charges to the conveyor belt, and an image forming part for forming an image on the recording paper, the image forming apparatus comprising:

a cleaning part configured to clean a surface of the conveyor belt by rotating the conveyor belt and setting a contacting member in contact with the surface of the conveyor belt when a bias voltage of the charges is reduced; and a protective member for covering an image forming part;

wherein the cleaning part is configured to clean the surface of the conveyor belt when a printing process forming an image and a post-printing process are completed by the image forming part and another image forming request is not received by the receiving part;

wherein the post-printing process is performed after the printing process and includes a process of moving the image forming part to a position of the protective member and a process of covering the image forming part with the protective member, wherein the cleaning part is configured to start the cleaning of the surface of the conveyor belt after the post-printing process is completed.

2. The image forming apparatus as claimed in claim 1, further comprising:

a measuring part configured to count a number of pages of the recording paper on which the image is formed and calculate a number of accumulated printed pages by using the counted number of pages;

wherein the cleaning part is configured to clean the surface of the conveyor belt in a case where the printing process and the post-printing process are completed by the image forming part, the other image forming request is not received by the receiving part, and the calculated number of accumulated printed pages is equal to or greater than a predetermined value.

3. The image forming apparatus as claimed in claim 1, further comprising:

a measuring part configured to count a number of pages of the recording paper on which the image is formed and calculate a number of accumulated printed pages by using the counted number of pages;

wherein the cleaning part is configured to clean the surface of the conveyor belt when the printing process and the post-printing process are completed by the image forming part and the other image forming request is not received by the receiving part or when the calculated number of accumulated printed pages is greater than a predetermined value.

4. The image forming apparatus as claimed in claim 1, further comprising:

a cover configured to open and close for covering the inside of the image forming apparatus; and a cover open/close detecting part for detecting opening and closing of the cover;

wherein the cleaning part is configured to clean the surface of the conveyor belt when the printing process and the post-printing process are completed by the image forming part and the other image forming request is not received by the receiving part or when the opening of the cover is detected by the cover open/close detecting part.

5. The image forming apparatus as claimed in claim 4, further comprising:

a time measuring part configured to measure the time in which the cover is opened and calculate an accumulated cover open time by using the measured time;

wherein the cleaning part is configured to clean the surface of the conveyor belt when the printing process and the post-printing process are completed by the image forming part and the other image forming request is not received by the receiving part or when the calculated accumulated open time is greater than a predetermined value.

6. The image forming apparatus as claimed in claim 1, wherein the image forming apparatus further comprises:

a measuring part configured to count a number of pages of the recording paper on which the image is formed and calculate a number of accumulated printed pages by using the counted number of pages, said number of pages being calculated for each different type of the recording paper and the number of the accumulated printed pages being a sum of the number of pages of the recording paper for the each different type of the recording paper, wherein the cleaning part is configured to clean the surface of the conveyor belt in a case where the printing process and the post-printing process are completed by the image forming part, the other image forming request is not received by the receiving part, and the calculated number of accumulated printed pages is equal to or greater than a predetermined value.

7. The image forming apparatus as claimed in claim 1, wherein the number of pages of the recording paper for the each different type of the recording paper is weighted based on a type of the recording paper.

8. An image forming system comprising:

a data processing apparatus configured to transmit an image forming request; and an image forming apparatus connected to the data processing apparatus, the image forming apparatus including a receiving part for receiving the image forming request from the data processing apparatus, a conveyor belt for rotating and conveying a recording paper thereon, a charging part for applying charges to the conveyor belt, an image forming part for forming an image on the recording paper, a protective member for covering an image forming part; and a cleaning part configured to clean a surface of the conveyor belt by rotating the conveyor belt and setting a contacting member in contact with the surface of the conveyor belt when a bias voltage of the charges is reduced;

wherein the cleaning part is configured to clean the surface of the conveyor belt when a printing process forming an image and a post-printing process are completed by the image forming part and another image forming request is not received by the receiving part;

wherein the post-printing process is performed after the printing process and includes a process of moving the image forming part to a position of the protective member and a process of covering the image forming part with the protective member, wherein the cleaning part is configured to start the cleaning of the surface of the conveyor belt after the post-printing process is completed.

9. A non-transitory recording medium on which a program is recorded for causing an image forming apparatus to perform an image forming method, the image forming method comprising the steps of:

a) receiving an image forming request at the image forming apparatus;

b) rotating a conveyor belt of the image forming apparatus;

c) conveying a recording paper on the conveyor belt;

d) applying charges to the conveyor belt, e) forming an image on the recording paper, f) performing a post-printing process, and g) cleaning a surface of the conveyor belt by rotating the conveyor belt and setting a contacting member in contact with the surface of the conveyor belt when a bias voltage of the charges is reduced, wherein the surface of conveyor belt is cleaned when steps e) and f) are completed and another image forming request is not received in step a).

* * * * *